US007338033B2

(12) United States Patent
Anson et al.

(10) Patent No.: US 7,338,033 B2
(45) Date of Patent: Mar. 4, 2008

(54) PORTABLE SAFETY BARRIER SYSTEM

(75) Inventors: Andrew Philip Anson, 8820 Elmslie Rd, Lasalle, Quebec (CA) H8R 1V6; Benjamin Anson, 431 Lakeshore Rd, Beaconsfield, Quebec (CA) H9W 4J3

(73) Assignees: Andrew Philip Anson, Lasalle (CA); Benjamin Anson, Beaconsfield (CA)

( * ) Notice: Subject to any disclaimer, the term of this patent is extended or adjusted under 35 U.S.C. 154(b) by 47 days.

(21) Appl. No.: 11/000,901

(22) Filed: Dec. 2, 2004

(65) Prior Publication Data

US 2006/0011901 A1 Jan. 19, 2006

(30) Foreign Application Priority Data

Jun. 30, 2004 (CA) ..... 2472814

(51) Int. Cl.
*E04H 17/00* (2006.01)

(52) U.S. Cl. ..... 256/65.14; 256/59; 256/64; 256/65.01

(58) Field of Classification Search ..... 256/65.14, 256/24, 56, 65.01, 25, 64, 59
See application file for complete search history.

(56) References Cited

U.S. PATENT DOCUMENTS 3,020,023 A * 2/1962 MacIntyre et al. ..... 256/24
3,776,521 A 12/1973 Weinert
5,842,685 A * 12/1998 Purvis et al. ..... 256/67
6,220,577 B1 * 4/2001 Ostrow ..... 256/67
6,554,257 B1 * 4/2003 Kenton ..... 256/24
6,578,827 B2 * 6/2003 McCracken ..... 256/59

FOREIGN PATENT DOCUMENTS

CA 1299002 12/1987

* cited by examiner

*Primary Examiner*—Daniel P. Stodola
*Assistant Examiner*—Nahid Amiri

(57) ABSTRACT

A support post base for a portable safety rail or fence system, said base having a top face side, an opposed bottom face side for contacting a support surface, and first toe rail holder slots or channels configured for detachably engaging a toe rail component for horizontal disposition thereof, said top face side presenting support post engagement (upright) sockets, pins, or the like configured for detachably engaging one or more support posts for upstanding disposition thereof.

7 Claims, 22 Drawing Sheets

PORTABLE SAFETY BARRIER SYSTEM

The present invention relates to components for a portable safety rail or fence system as well as such system itself. Although such a system may be used in any circumstance where a temporary safety fence is desired or required, the system will be discussed herein in relation to elevated working surfaces.

During the initial construction of a floor of a high rise type building, the outer side walls may for a time be missing. Occupational safety standards require that until such side walls are in place that a safety railing or fence be disposed around the margins of the elevated partially constructed floor in order to provide some protection for workers or other individuals from accidentally falling over the edge of the elevated floor surface. Another type of elevated working surface which may require such a safety barrier is the roof of a building, e.g. during roofing replacement or repair. Such railings may be of wood construction; however, the construction of such wooden barrier is time consuming and does not favour reuse of barrier materials or components since the dismantling of the wooden barrier may lead to material breakage.

Accordingly, it has been proposed in U.S. Pat. No. 3,776,521 to provide a temporary portable safety railing system which is convenient to build up and to take apart for storage and transport; the entire contents of this patent are incorporated herein by reference. As described in this patent, the temporary portable safety railing system may be built up from barrier unit components which may be subsequently taken apart as desired. A barrier unit as described in this patent may comprise a horizontal barrier component (e.g. at least one horizontal rail or bar member) and one or more spaced apart vertical posts members for supporting the barrier component in a vertically extending fashion, i.e. above the support surface on which the barrier unit rests. The post members are detachably secured to and supported in a vertical disposition by respective appropriately bases. The bases as shown in this patent each have a pair of socket members for receiving and detachably maintaining the posts in such vertical disposition. The horizontal barrier component may comprise two or more (vertically) spaced apart rail or bar members. As described in this patent, since the horizontal barrier component may be subjected to forces generating tipping moments (in said posts), the sockets of the bases are configured for transmitting tipping moments of said posts to said bases, the weight of the bases counteracting the tipping moments.

The bases described in U.S. Pat. No. 3,776,521 are also taught as being square and as having inwardly extending notches at each corner for receiving a toe rail member (e.g. a slab-like member) beneath the horizontal barrier component so that the toe rail member can lie along the support surface. The toe rail member provides an additional safety feature in that the toe rail member acts as a barrier for inhibiting objects on the support surface from being (accidentally) kicked or otherwise urged over the marginal edge of a support surface; i.e. to inhibit undesired falling missiles which could inflict injury on a person at a level lower than the elevated floor surface protected by the safety barrier.

As mentioned the base described in the patent has a square shape and has corner toe rail notches. A problem with such base configuration, however, arises at barrier corners in that the bases are not easily able to accommodate toe rail members at corners; i.e. at a square corner of a support surface an underlying toe rail member, when viewed from above, will be misaligned in relation to the overhead barrier component, i.e. will be non-parallel to the overhead horizontal barrier component, when viewed from above. This may place a person installing or taking down the safety barrier system at risk of falling over the marginal edge of a support surface at the corner. An installer, may, for example, have to apply exceptional exertion in relation to the positioning of the base or the toe rail in such manner as to risk being put off balance at the marginal edge of an elevated support surface.

It would thus be advantageous to be able to have a base for a temporary barrier system which could facilitate the building of a barrier corner or the like.

In order to facilitate storage as well as transport of a plurality of bases, it would be advantageous to have a base configured such that a like base may be stacked thereon in a face to face relationship such that the base and the overlying, like, base interlock such that lateral displacement of the overlying, like, base relative to the base is inhibited. In this manner a plurality of such pairs of stacked bases may in turn be stacked in bottom side face to bottom side face relation.

As also mentioned above, socket members of the bases shown in U.S. Pat. No. 3,776,521 are described as being configured for transmitting tipping moments of posts to weighted bases. Circumstance may arise wherein it may be desirable or necessary to provide bases of different weight i.e. of increased weight in order to augment the ability of a base to counteract the above mentioned tipping action. This problem may be met by providing bases of different size or made of different density material. However it would be advantageous to be able to augment the weight of a base unit without recourse to bases of different size or made of different density material.

It would also be advantageous to have a weighted base able to accommodate corners of greater than 90 degrees (i.e. greater than right angle), i.e. combinations of barrier component and toe rail component defining corner angle greater the 90 degrees such as for example 135 degrees, 215 degrees, etc.

SUMMARY OF INVENTION

The present invention relates to a support post base, said base having a top face side, an opposed bottom face side for contacting a support surface, and first toe rail holder means (e.g. holder slot or channel element(s)) configured for detachably engaging a toe rail component for horizontal disposition thereof, said top face side presenting i. support post engagement means (e.g. (upright) socket, pin, or the like) configured for detachably engaging one or more support posts for upstanding disposition thereof.

In accordance with the present invention, each support post engagement means (or engagement element) may, by way of example, be configured for detachably securing thereto a support post of a respective portable safety barrier unit/component for upstanding disposition of the support post (i.e. upwardly in relation to the base and for transmitting the tipping moments of the post to the base). To this end, a base in accordance with the present invention, may be appropriately weighted (and/or sized) keeping in mind its function in relation to a safety barrier system, namely to be able support in upstanding fashion a support post of a horizontal barrier component as described herein. A horizontal barrier component is barrier component which has one or more elements which, once the horizontal barrier component is attached to the base(s), extend horizontally. It is thus to be understood herein that the expression "horizontal barrier component" in the context of a safety barrier unit, system etc. is a reference to a construct which may be configured so as to be able to be supported and to present a desired horizontally extending barrier.

The present invention thus in particular relates to a support post base for (inhibiting tipping of a portable safety barrier (e.g. rail) unit of) a portable safety barrier system (subjectable to forces generating tipping moments in/through a support post of the portable safety barrier (e.g. rail) unit). In order to provide the desired or necessary stability to a safety barrier system a base in accordance with the present invention may, as known (see above mentioned U.S. Pat. No. 3,776,521), be made of a relatively dense (metallic) material (cast iron); other configurations may be used including bases configured so as to be able to filled, with water, lead particle (e.g. balls, pellets, etc.). In any event the weight of the base may be determined in relation to the nature of the barrier component it is desired to support. As mentioned in U.S. Pat. No. 3,776,521, the weight may be chosen on the basis that the weight of the base is to inhibit displacement of the base along the support surface as well as tipping of a barrier component. A base in accordance with the present invention may, for example, have a weight of 25 to 75 kilograms; it is of course understood that a base may as necessary or desired have a different weight keeping in mind its function.

In accordance with the present invention a toe rail holder means (e.g. holder slot or channel element) may configured in any suitable manner for detachably securing thereto a respective toe rail component for horizontal disposition thereof outwardly from the base (e.g. for a horizontal orientation of the toe rail along support surface underlying the base). The toe rail holder means may for example comprise, inter alia, a single slot element passing from one peripheral side of the base to the other along a horizontal longitudinal axis. In this case a single toe rail component such as a toe rail in the form of a single elongated plank may extend horizontally from two opposed sides of the base. If desired or necessary, the toe rail holder means may for example comprise one or more pairs of opposed slot elements, each slot element being disposed along a horizontal longitudinal axis with support post engagement means disposed there between also along the same horizontal longitudinal axis. In this latter case the slot elements may engage the ends of separate respective toe rails (e.g. planks).

A support post base in accordance with the present invention may, as desired or necessary, additionally have a bottom side face which presents socket engagement means for engaging said one or more support posts.

A support post base in accordance with the present invention may, as desired or necessary, additionally have second toe rail holder means configured for detachably engaging a respective toe rail component for horizontal disposition thereof, said second toe rail holder means being disposed along a second horizontal alignment axis, said second horizontal alignment axis being disposed transverse to the first horizontal alignment axis.

A support post base in accordance with the present invention may, as desired or necessary, additionally have male interlock means and female interlock means whereby a base and a like base may be stacked and interlocked such that relative horizontal linear displacement thereof is inhibited (i.e. horizontal linear or sidewise displacement is inhibited).

In accordance with an aspect of the present invention there is provided a support post base, said base having two or more support post engagement elements (e.g. (upright) sockets, pins, or the like), each support post engagement element being configured for detachably engaging a support post for upstanding disposition thereof, (i.e. of the support post in a vertically extending fashion), first toe rail holder means (e.g. holder slot or channel element(s)) configured for detachably engaging a respective toe rail component for horizontal disposition thereof, second toe rail holder means (e.g. holder slot or channel element(s)) configured for detachably engaging a respective toe rail component for horizontal disposition thereof, the first toe rail holder means and two of said support post engagement elements being disposed along a first horizontal alignment axis one of the support post engagement elements disposed along the first horizontal alignment axis being disposed at the intersection of the first horizontal alignment axis and a second horizontal alignment axis disposed transverse to the first horizontal alignment axis, and the second toe rail holder means being disposed along said second horizontal alignment axis.

The above described base configuration has the salutary effect of facilitating the fabrication of cleanly defined corner elements of a temporary safety barrier installation (see below).

The present invention further provides a support post base, said base having a top face side, an opposed bottom face side for contacting a support surface, two spaced apart first toe rail holder elements (e.g. holder slot or channel element(s)) and two spaced apart second toe rail holder elements (e.g. holder slot or channel element(s))

said top face side presenting a first support post engagement element (e.g. (upright) socket, pin, or the like) spaced apart from a second support post engagement element (e.g. (upright) socket, pin, or the like), each support post engagement element being configured for detachably engaging a support post for upstanding disposition thereof, (i.e. of the support post in vertically extending fashion), each toe rail holder element being respectively configured for detachably engaging a respective toe rail member for horizontal disposition thereof, the first toe rail holder elements and the first and second post engagement elements each being disposed along a first horizontal alignment axis such that the first and second post engagement elements are disposed between said first toe rail holder slot elements the first post engagement element being disposed at the intersection of the first horizontal alignment axis and a second horizontal alignment axis disposed transverse to the first horizontal alignment axis, and the second toe rail holder elements and the first post engagement element being disposed along said second horizontal alignment axis such that the first post engagement element is disposed between said second toe rail holder slot elements.

In accordance with the present invention, the first post engagement element and the second post engagement element may each comprise a respective male element for engaging a respective support post for upstanding disposition of said support post. Such a male element may, for example, take the form of a solid pin like member or be of hollowed construction (i.e. be a male element defining a socket for engaging a respective support post). In accordance with the present invention, the above mentioned male elements (of the base) may each have distal ends (i.e. ends remote from the point of attachment of the male elements to the rest of the base), and, as shall be discussed below, the base may further comprise a female component disposed along a third horizontal alignment axis, said third horizontal alignment axis being transverse to said first horizontal alignment axis and being between said first and second support post engagement elements, said female component comprising an opening extending from said top face side to said bottom face side and wherein said first post engagement element, said second post engagement element, said female component, said top face side and said bottom face side, are configured such that, when the base (i.e. underlying base) and an overlying, like, base are stacked top face side to top face side the male elements of the base (i.e. underlying base) are able to register with the female component of said overlying, like, base and the male elements of said overlying, like, base are able to register with the female component of the base (i.e. underlying base) so as to be able to interlock the base (i.e. underlying base) and said overlying, like, base such that horizontal displacement of the overlying, like, base relative to the base (i.e. underlying base) is inhibited, the distal ends of the male elements of the base (i.e. underlying base) are disposed in the opening of the female component of said overlying, like, base and the male elements of the base (i.e. underlying base) are able to detachably engage a respective support post for upstanding disposition thereof.

As mentioned above (as well as herein below) a base in accordance with the present invention may be configured so as to be stacked in face to face arrangement so as, necessary or desired, to facilitate storage, transport and/or provide a base member of increased weight for a barrier unit as described herein below.

Thus in accordance with a more general aspect the present invention provides a support post base, said base having a top face side, an opposed bottom face side for contacting a support surface, and first toe rail holder means (e.g. holder slot or channel element(s)) configured for detachably engaging a toe rail component for horizontal disposition thereof, said top face side presenting i. support post engagement means (e.g. (upright) socket, pin, or the like) configured for detachably engaging one or more support posts for upstanding disposition thereof, ii. female interlock means (i.e. male interlock component) and iii. female interlock means (i.e. female interlock component)

wherein said top face side, said bottom face side, said support post engagement means, said male interlock means and said female interlock means are configured such that, when the base and an overlying, like base are stacked top face side to top face side the male interlock means of the base is able to register with the female interlock means of said overlying, like, base and the female interlock means of the base is able to register with the male interlock means of said overlying, like, base so as to be able to releasably interlock both bases such that relative horizontal displacement thereof is inhibited (i.e. horizontal linear or sidewise displacement is inhibited).

An interlockable base as described above may, for example, have a bottom side face which presents socket engagement means for engaging said one or more support posts and wherein said top face side, said bottom face side, said support post engagement means, socket engagement means, said male interlock means and said female interlock means are configured such that, when the base and an overlying, like, base are stacked top face to top face, the socket engagement means of the bottom side face of said overlying like base is able to detachably engage said one or more support posts for upstanding disposition thereof.

An interlockable base as described above may, for example, may be a base wherein said top face side, said bottom face side, said support post engagement means, said male interlock means and said female interlock means are configured such that, when the base and an overlying, like base are stacked top face side to top face side the first toe rail holder means the base (i.e. underlying base) is able to detachably engage a toe rail component for horizontal disposition thereof.

An interlockable base as described above may, for example further have second toe rail holder means configured for detachably engaging a respective toe rail component for horizontal disposition thereof, said second toe rail holder means being disposed along a second horizontal alignment axis, said second horizontal alignment axis being disposed transverse to the first horizontal alignment axis.

In accordance with the present invention the male interlock means and the female interlock means may take on any desired or suitable form keeping in mind their function, namely, to releasably interlock two like bases so as to inhibit horizontal (i.e. rotational and/or linear) displacement thereof. Thus male interlock means may be provided by the support post engagement means itself or by a separate distinct element. The female interlock means may comprise a female component for receiving a male element therein; the female interlock means may for example comprise a female component which comprises an opening for receiving a male element therein.

Thus in accordance with a particular aspect of the present invention there is further provided a support post base, said base having a top face side, an opposed bottom face side, and two spaced apart first toe rail holder elements (e.g. holder slot or channel element(s))

said top face side presenting a first support post engagement element (e.g. (upright) socket, pin, or the like) spaced apart from and a second post engagement element (e.g. (upright) socket, pin, or the like), each support post engagement element being configured for detachably engaging a respective support post for upstanding disposition thereof upwardly from said base, each toe rail holder element being respectively configured for detachably engaging a respective toe rail member for horizontal disposition thereof outwardly from said base, the first holder toe rail elements and the first and second support post engagement elements being disposed along a first horizontal alignment axis such that the first and second support post engagement elements are disposed between said first toe rail holder elements, said first post engagement element and said second post engagement element each comprising a male element for engaging a respective support post for upstanding disposition thereof upwardly from said base, and wherein said base further comprises a female component disposed along a second horizontal alignment axis, said second horizontal axis being transverse to said first horizontal alignment axis and being between said first and second support post engagement elements and wherein said top face side, said first support post engagement element, said second support post engagement element, and said female component, are configured such that, when the base and an overlying, like, base are stacked top face side to top face side the male elements of the base are able to register with the female component of said overlying, like, base and the male elements of said overlying, like, base are able to register with the female component of the base so as to be able to interlock both bases such that relative horizontal displacement thereof is inhibited (i.e. horizontal linear (e.g. lateral or sidewise) and possibly horizontal rotational displacement is inhibited).

As mentioned herein, a first post engagement element and a second post engagement element may each comprise a respective male element defining a socket for engaging a respective support post for upstanding disposition of said support post. A stackable base as described above may further have two spaced apart second toe rail holder elements, wherein the first post engagement element is disposed at the intersection of the first horizontal alignment axis and a third horizontal alignment axis (i.e. a third axis in addition to the second axis related to the female component) wherein the third horizontal alignment axis is disposed transverse to the first horizontal alignment axis, and wherein the second toe rail holder elements and the first post engagement element are disposed along said third horizontal alignment axis such that the first post engagement element is disposed between said second toe rail holder slot elements. In accordance with the present invention the bottom side face may present two spaced apart socket engagement elements for engaging respective support posts, said socket engagement elements each being disposed opposite a respective support post engagement element and wherein said top face side, said bottom face side, said support post engagement means, socket engagement means, said male interlock means and said female interlock means are configured such that, when the base and an overlying, like base are stacked top face to top face, the socket engagement elements said overlying like base are able to detachably engage a respective support post for upstanding disposition thereof. In accordance with the present invention, a stackable base as described herein may be a base wherein the male elements of the base each have distal ends, wherein the female component comprises an opening extending from said top face side to said bottom face side and wherein said first post engagement element, said second post engagement element, said female component, said top face side and said bottom face side, are configured such that, when the base and an overlying, like, base are stacked top face to top face the male elements of the base are able to register with the female component of said overlying, like, base and the male elements of said overlying, like, base are able to register with the female component of the base so as to be able to interlock the base and said overlying, like, base such that horizontal displacement of the overlying, like, base relative to the base is inhibited the distal ends of the male elements of the base are disposed in the opening of the female component of said overlying, like, base and the sockets of the male elements of the base are able to detachably engage a respective support post for upstanding disposition thereof.

In accordance with the present invention a support post engagement element of the top side face and a respective opposite socket engagement element of the bottom side face may define a socket channel extending from the top face side to the bottom face side for engagement of a support post in upstanding disposition.

In accordance with a further aspect the present invention provides a kit for a portable safety barrier system comprising at least two bases as described herein and at least one portable safety barrier unit comprising a horizontal barrier component attached to two spaced apart support posts.

A support post base, in accordance with the present invention may take on any desired or necessary base body configuration keeping in mind the purpose of the support post base as well as the structural elements as discussed herein. The invention will be discussed below, by way of example only, in relation to a base body configuration which is square-like or cone-like.

A safety barrier system may be installed by first placing (appropriately weighted) bases onto a support surface in a desired pattern. The toe rail members may then be disposed into the corresponding notches. Thereafter the posts of the horizontal barrier components may be engaged with the support post engagement elements of bases. If desired or necessary the barrier component may be fixed to the toe board. The reverse steps may be taken to break the safety barrier system down into its component parts for transport or storage.

The height of the posts and the length of the barrier components are selected so as to meet safety as well as work area requirements. The posts may, for example, have a height of from 1 to 2 meters; the barrier component may, for example, have a length of from 2 to 5 meters. Although the barrier component as shown hereinafter has two end posts; a barrier component may if desired or necessary have one or more additional posts intermediate the end posts; a barrier component may even have only a single post provided that the post is also able to maintain the barrier component in an upstanding disposition when engaged by a base.

In the drawing which illustrate an example embodiment (s) of the present invention:

FIG. 1 is a schematic perspective view of the prior art base as shown in U.S. Pat. No. 3,776,521;

Figure 5:
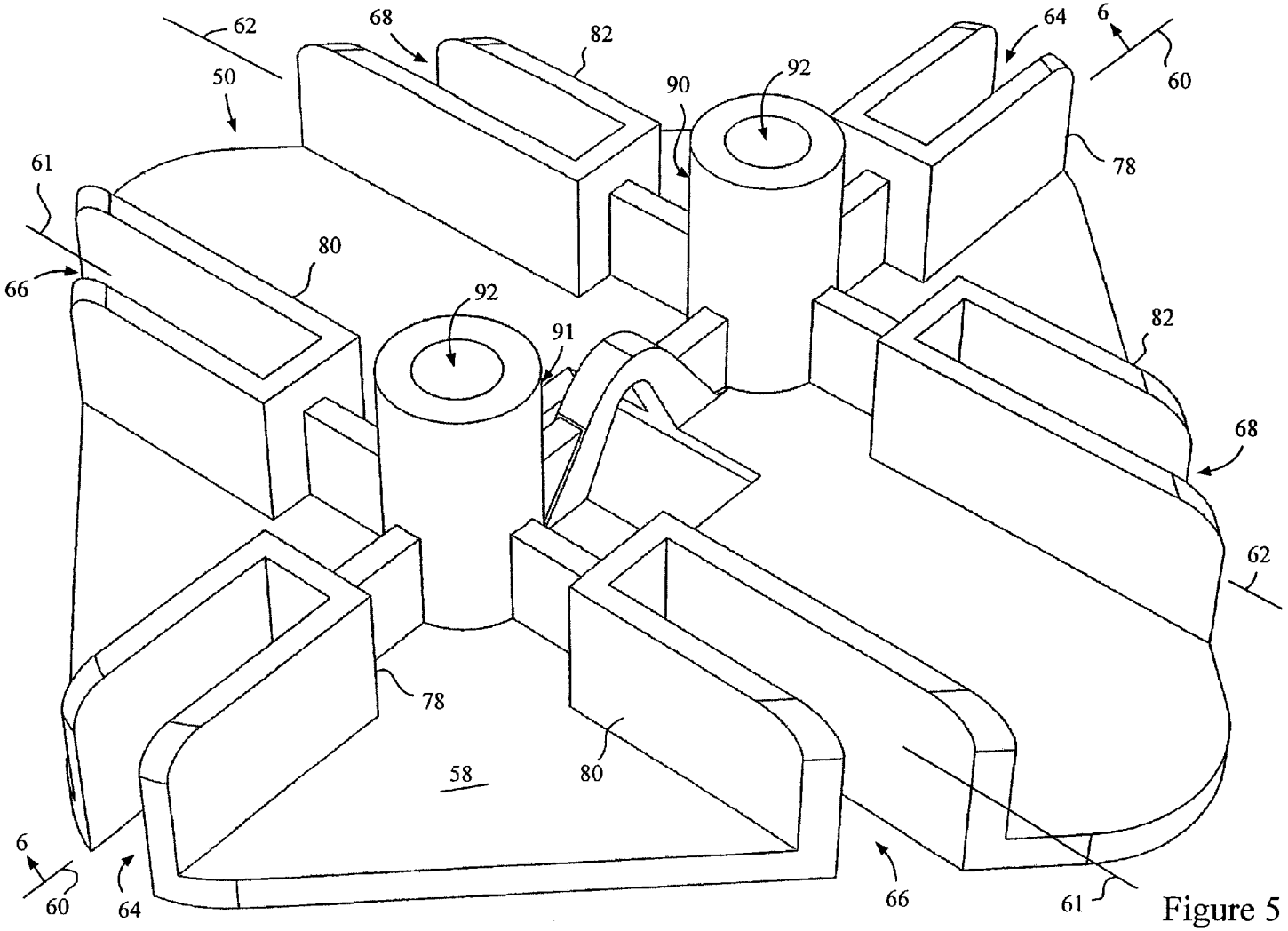
FIG. 5 is a schematic perspective view of an example embodiment of base in accordance with the present invention.
Figure 8:
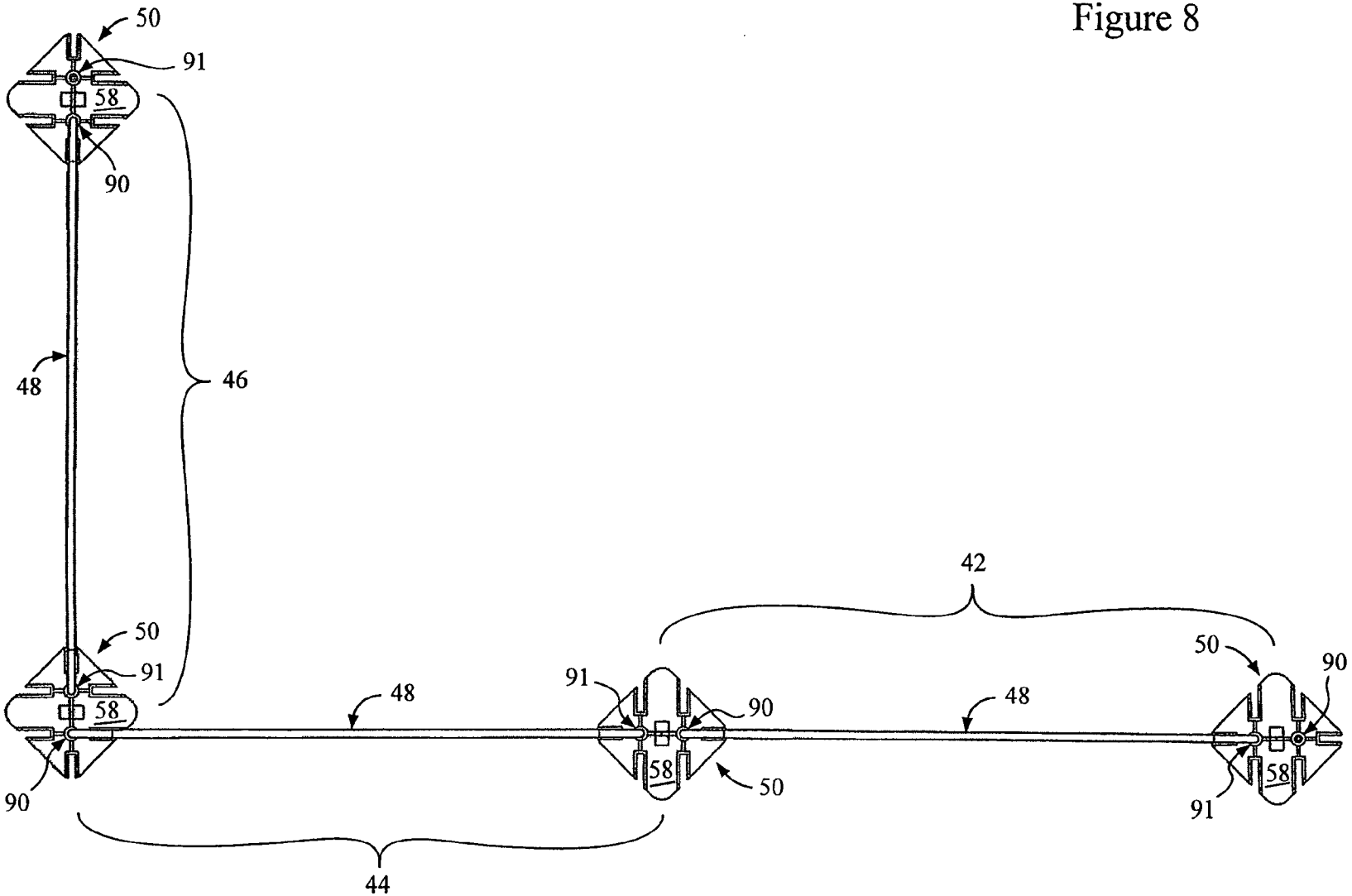
FIG. 8 is a schematic top view of a portable safety railing using bases as shown in FIG. 5 installed on a support surface.
Figure 8A:
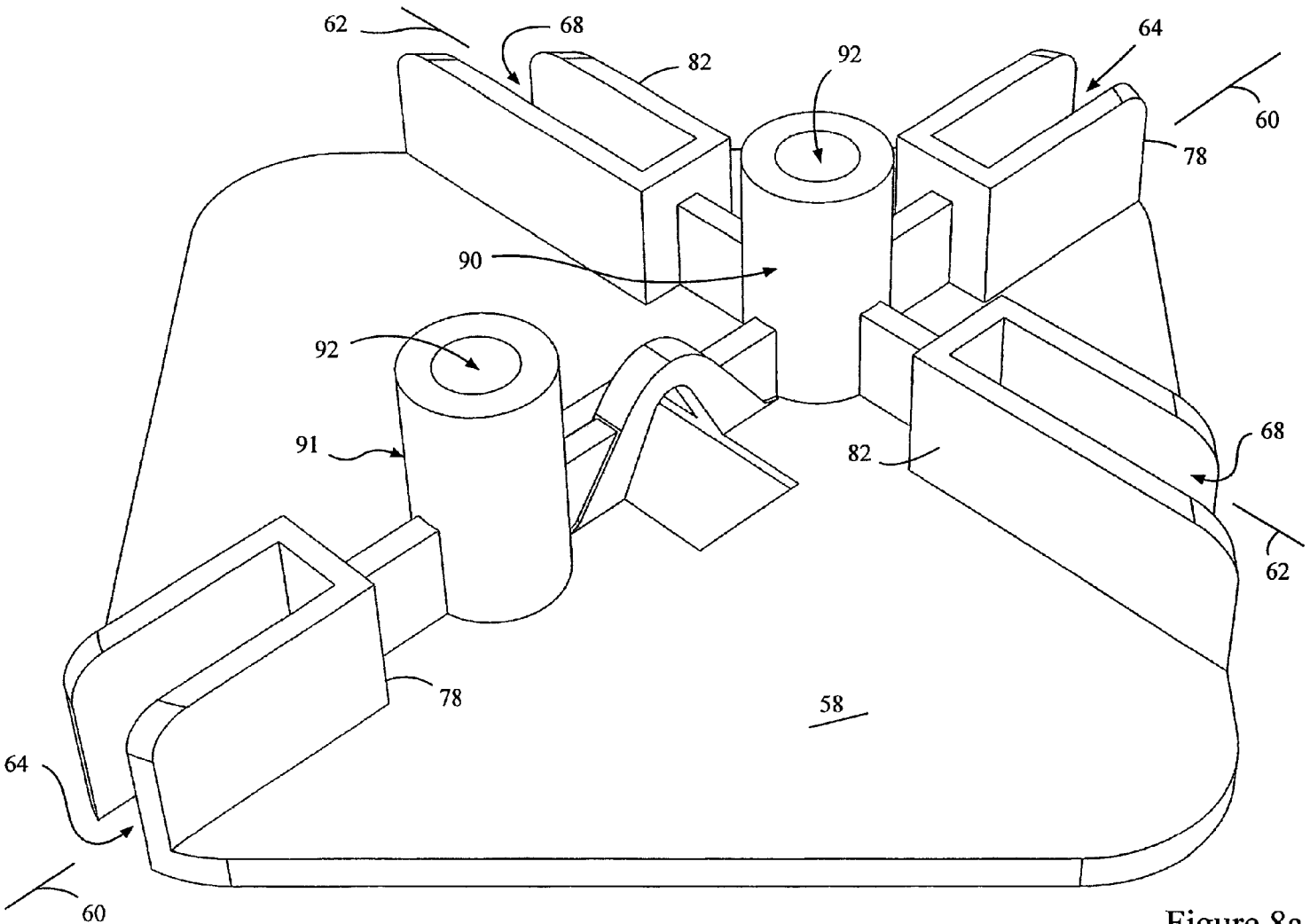
Figure 9:
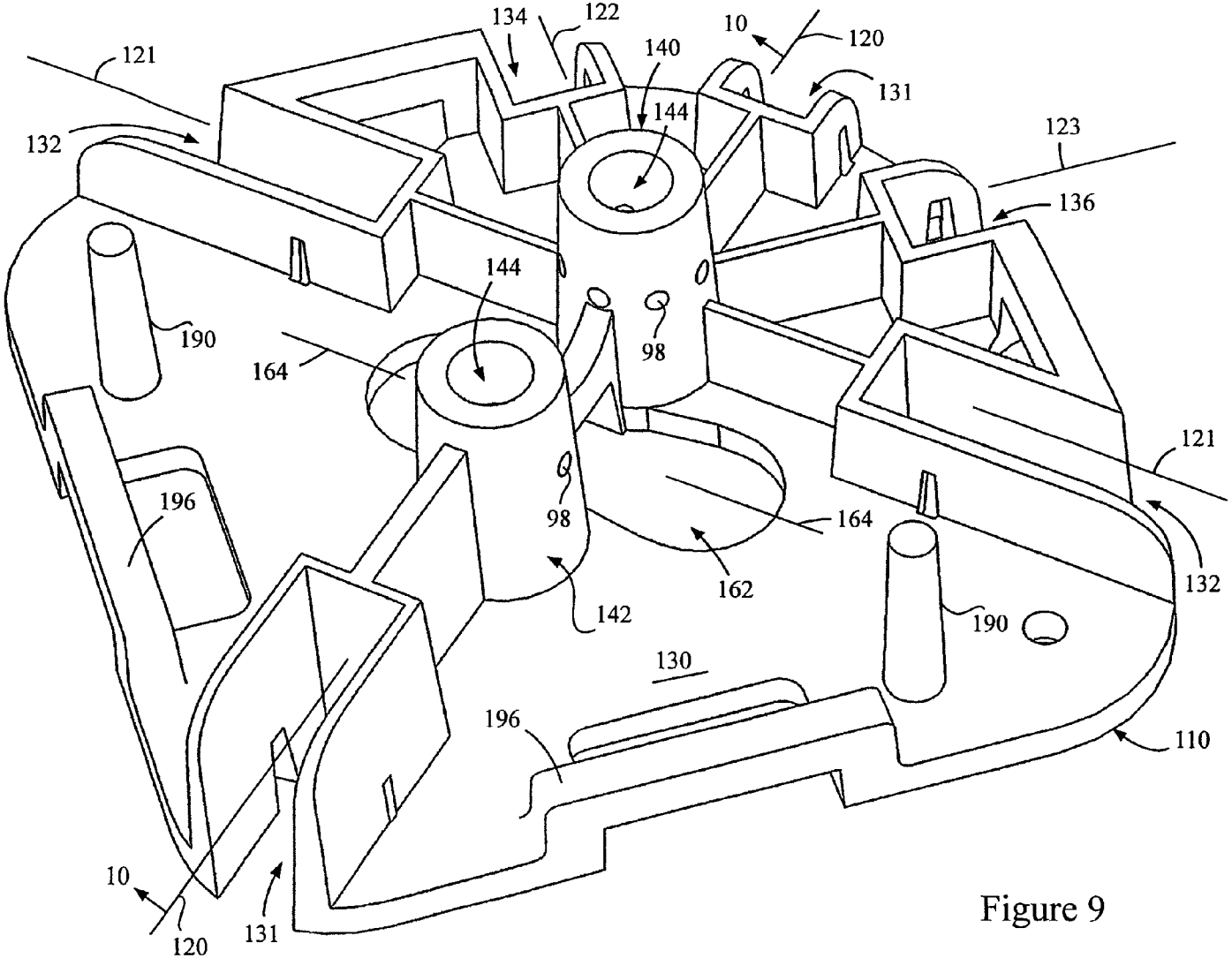
Figure 10:
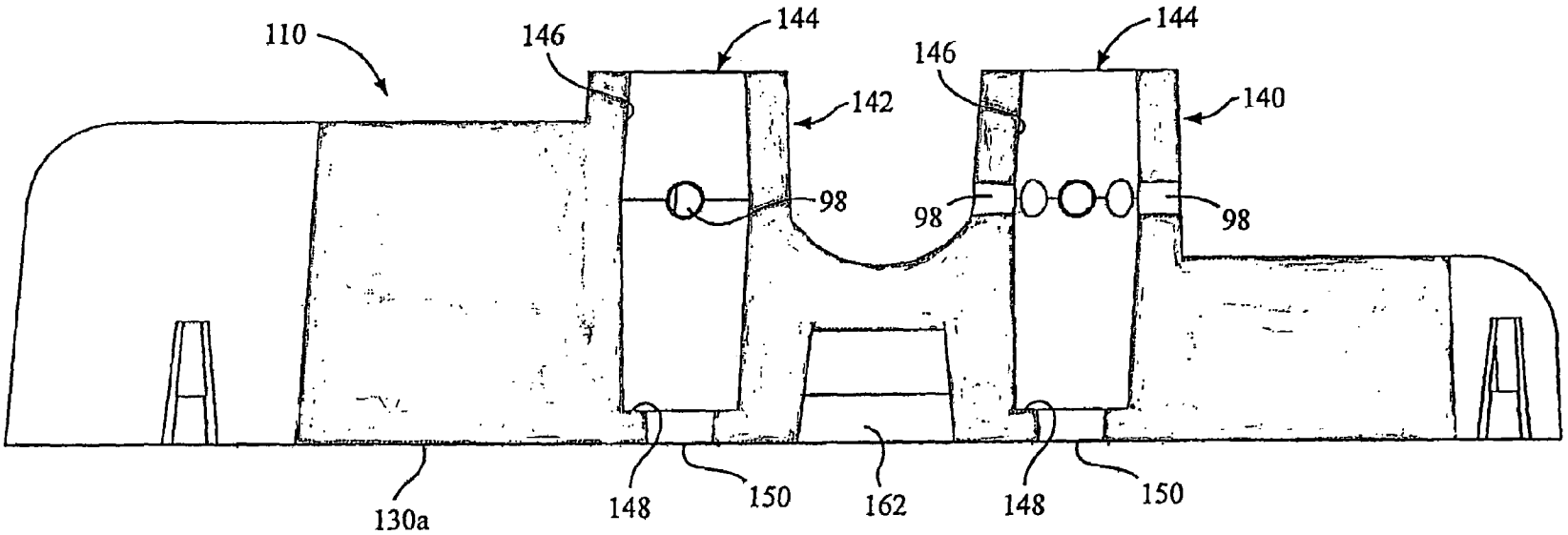
Figure 11:
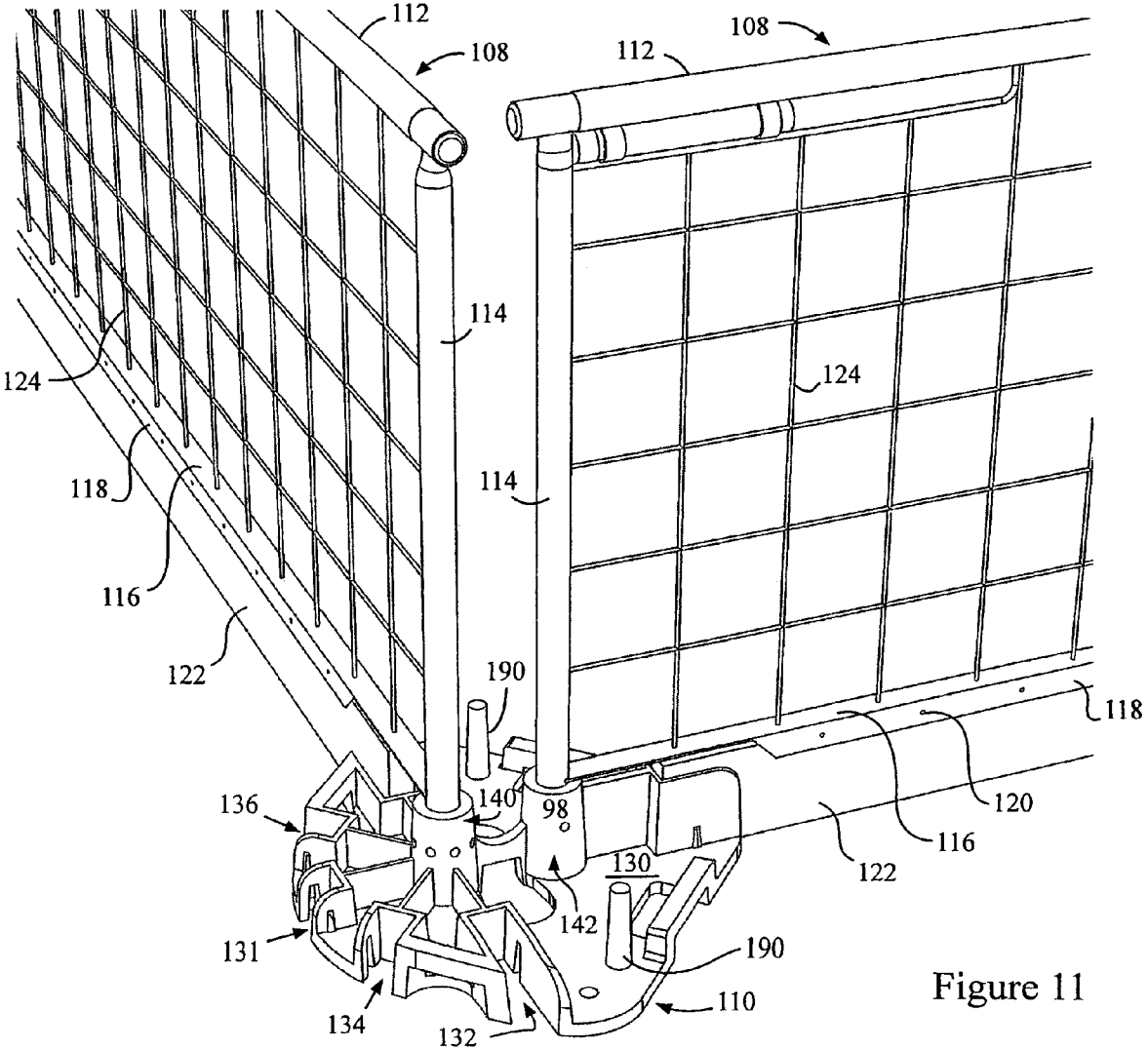
Figure 12:
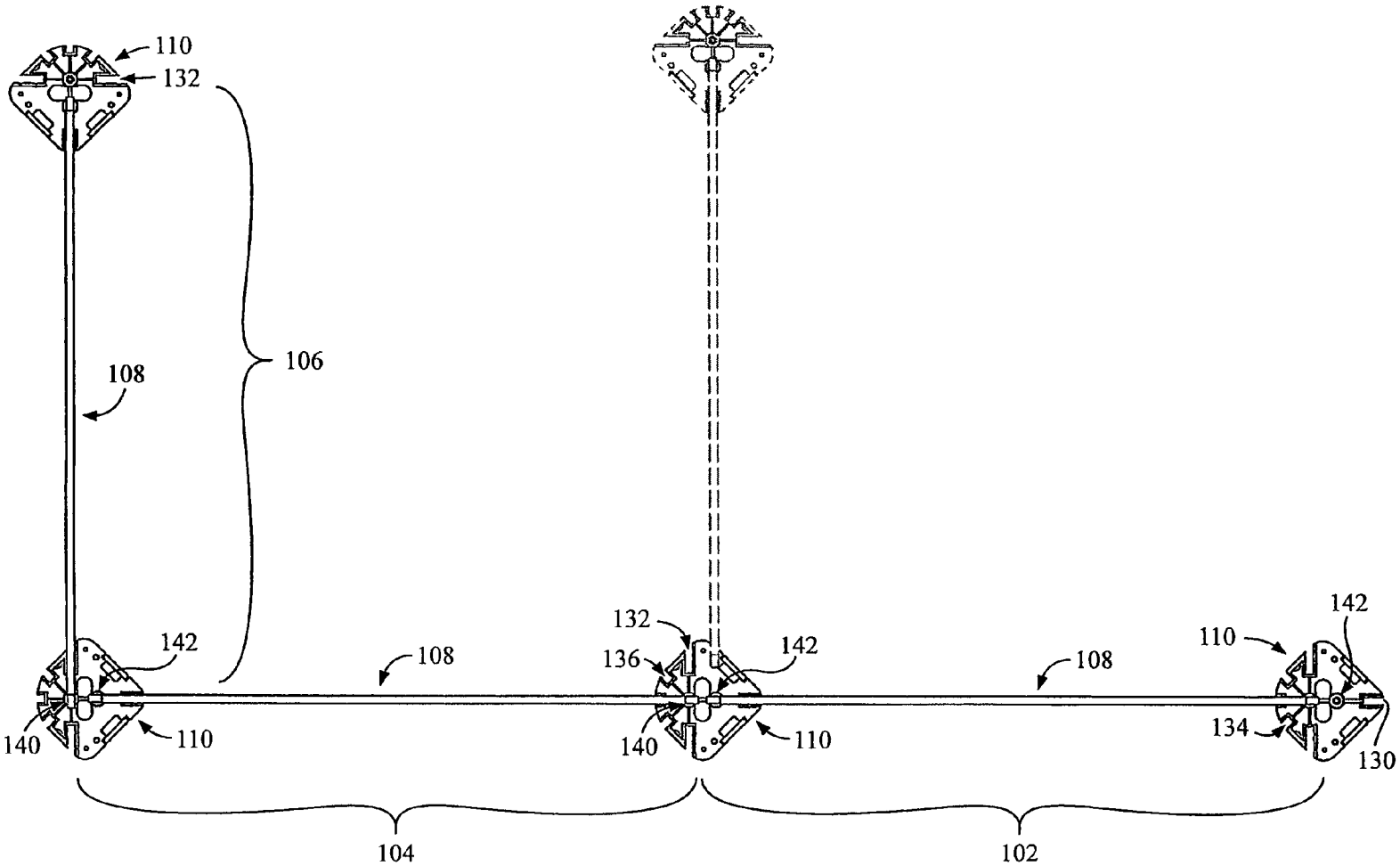
Figure 13:
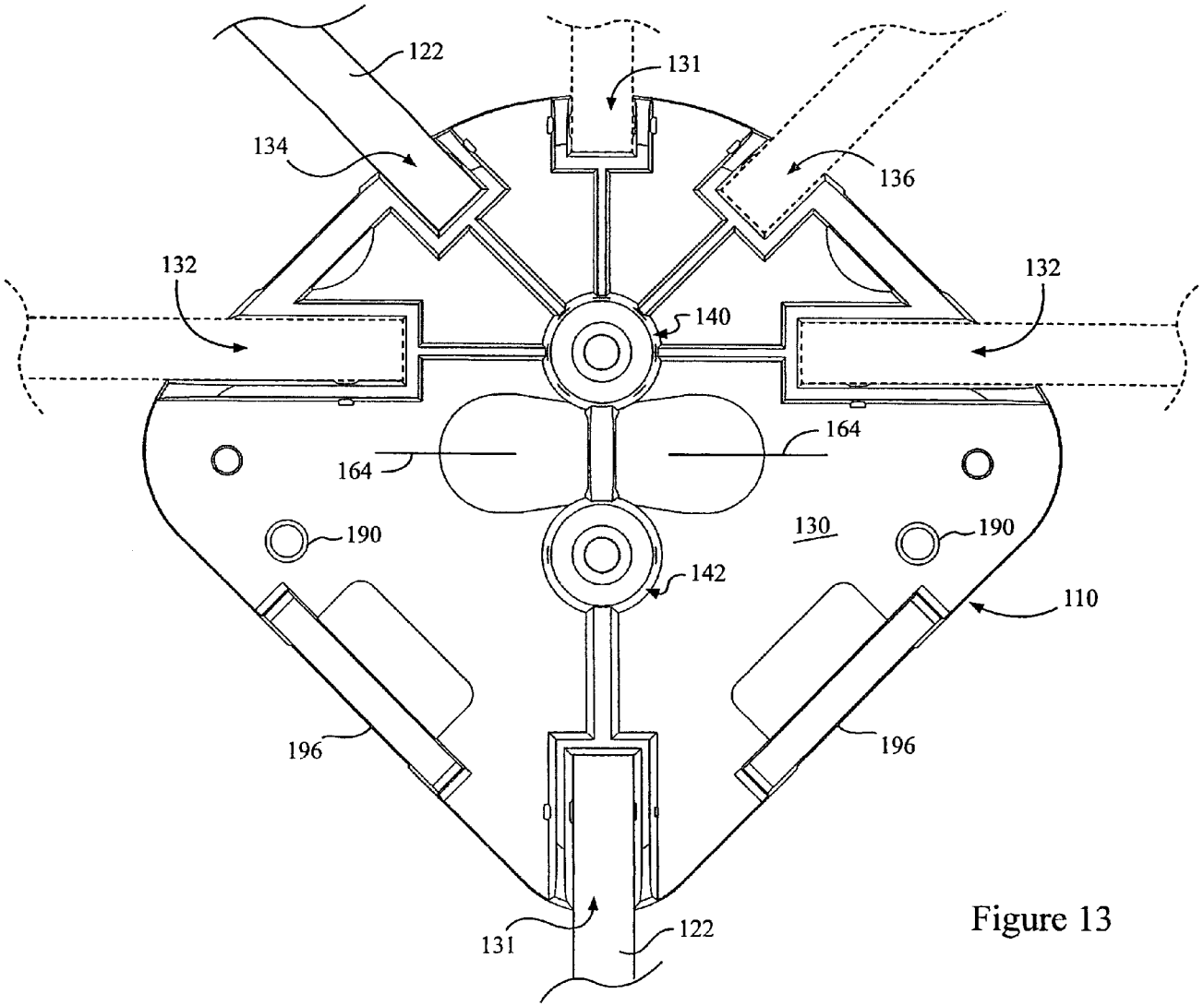
Figure 14:
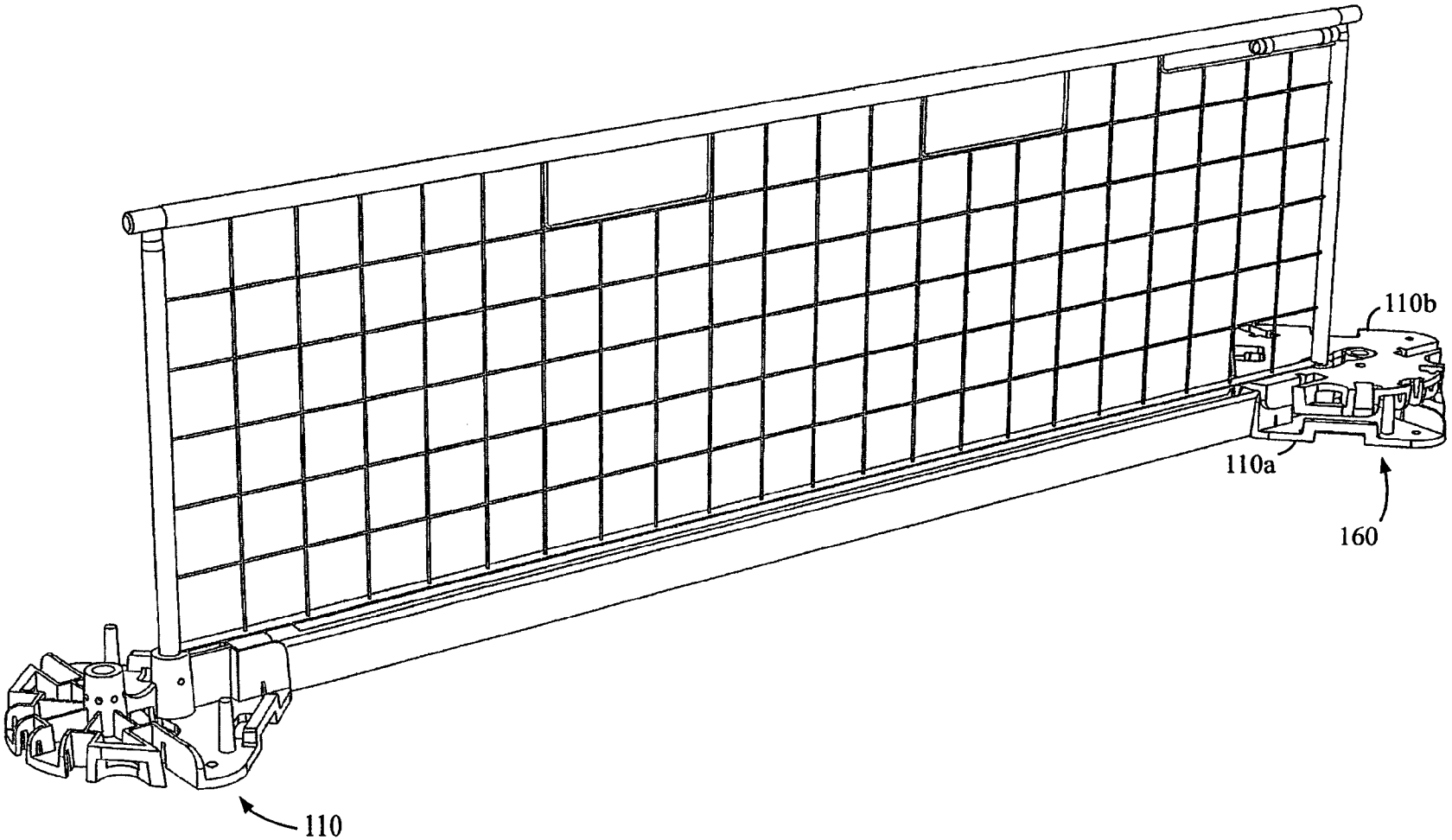
Figure 15:
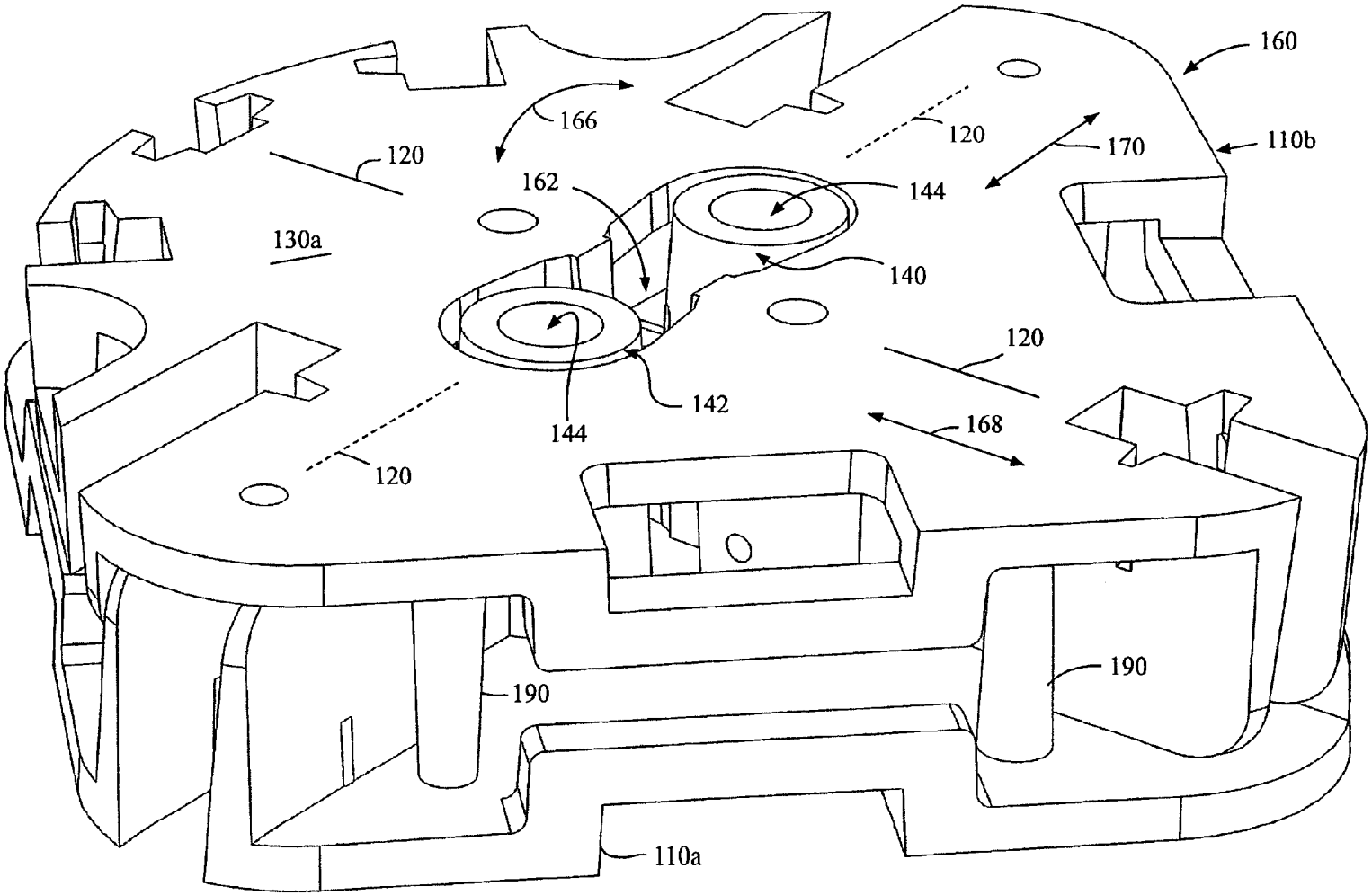
Figure 16:
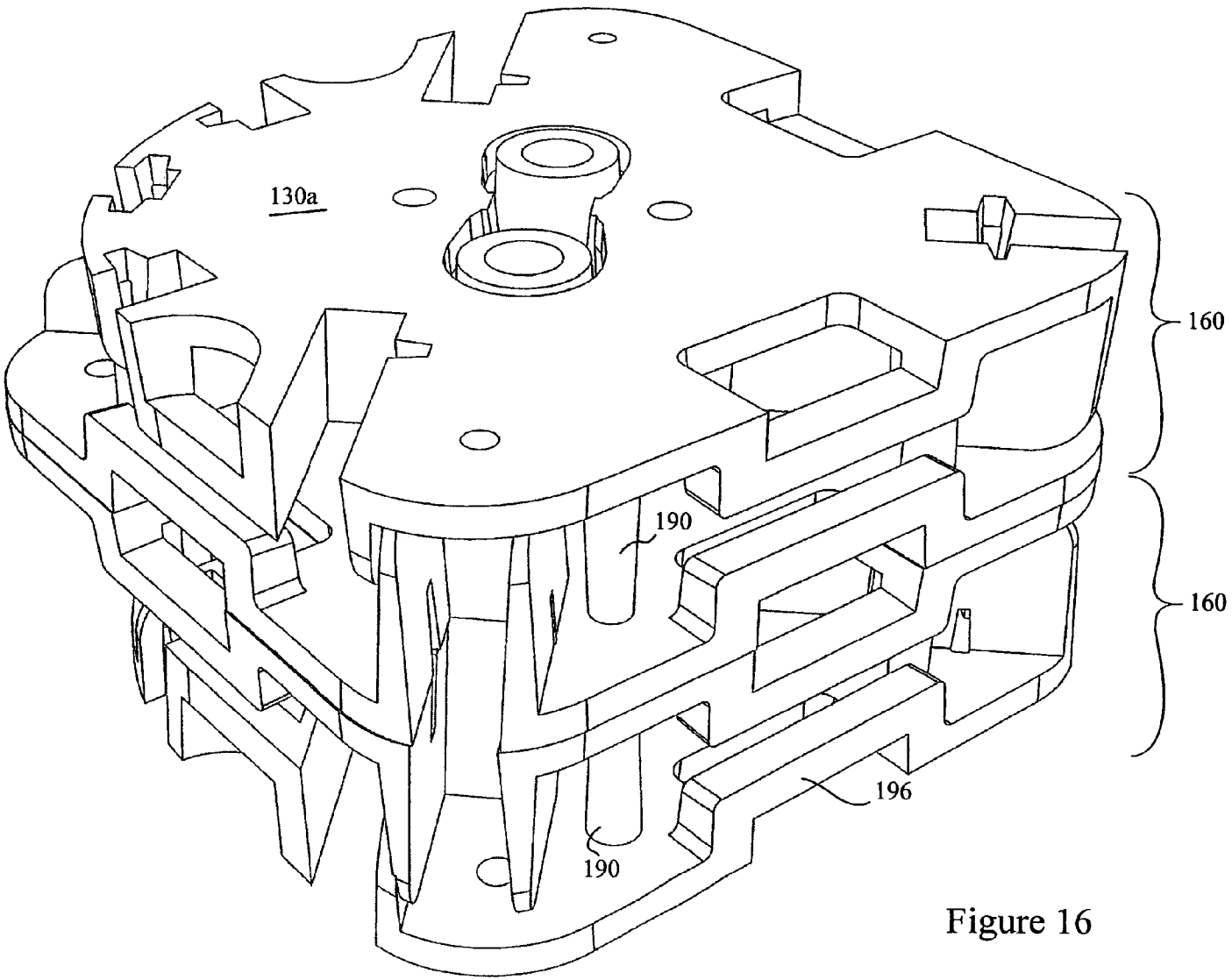
Figure 17:
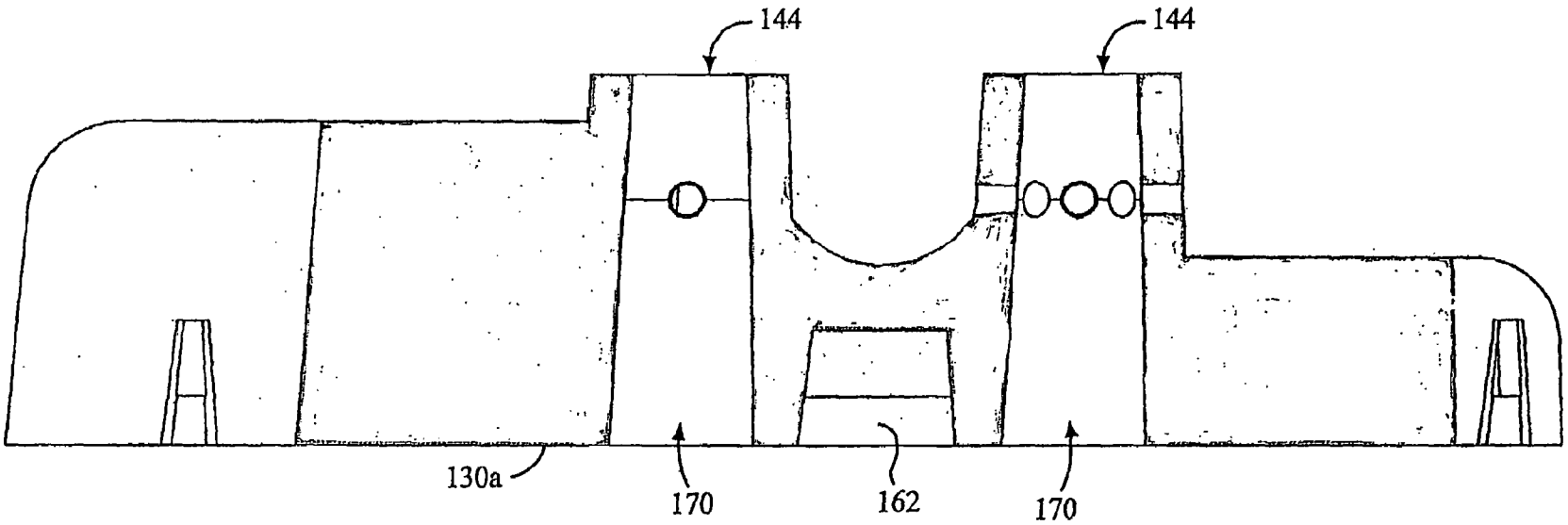
Figure 18:
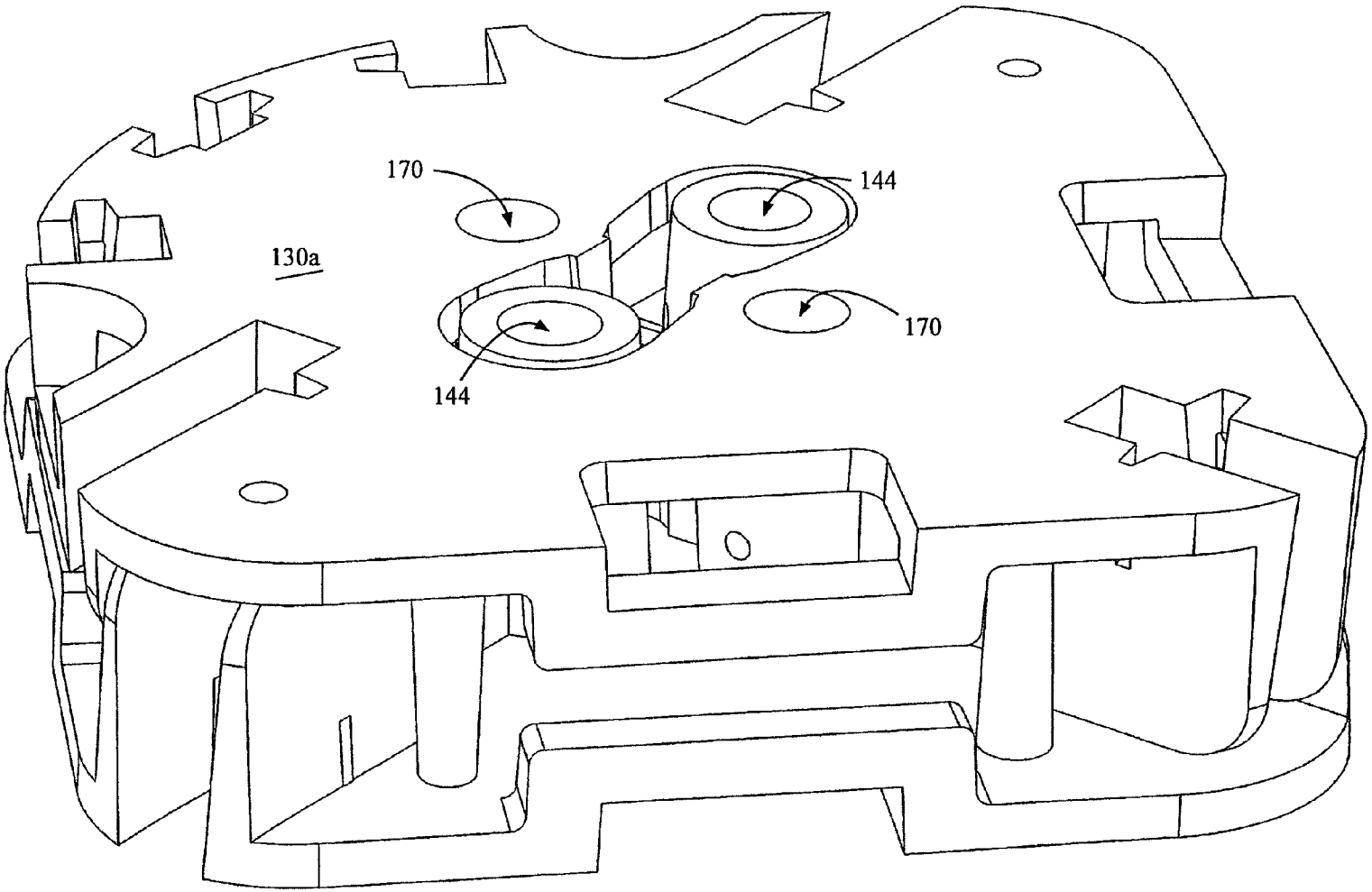
Figure 19:
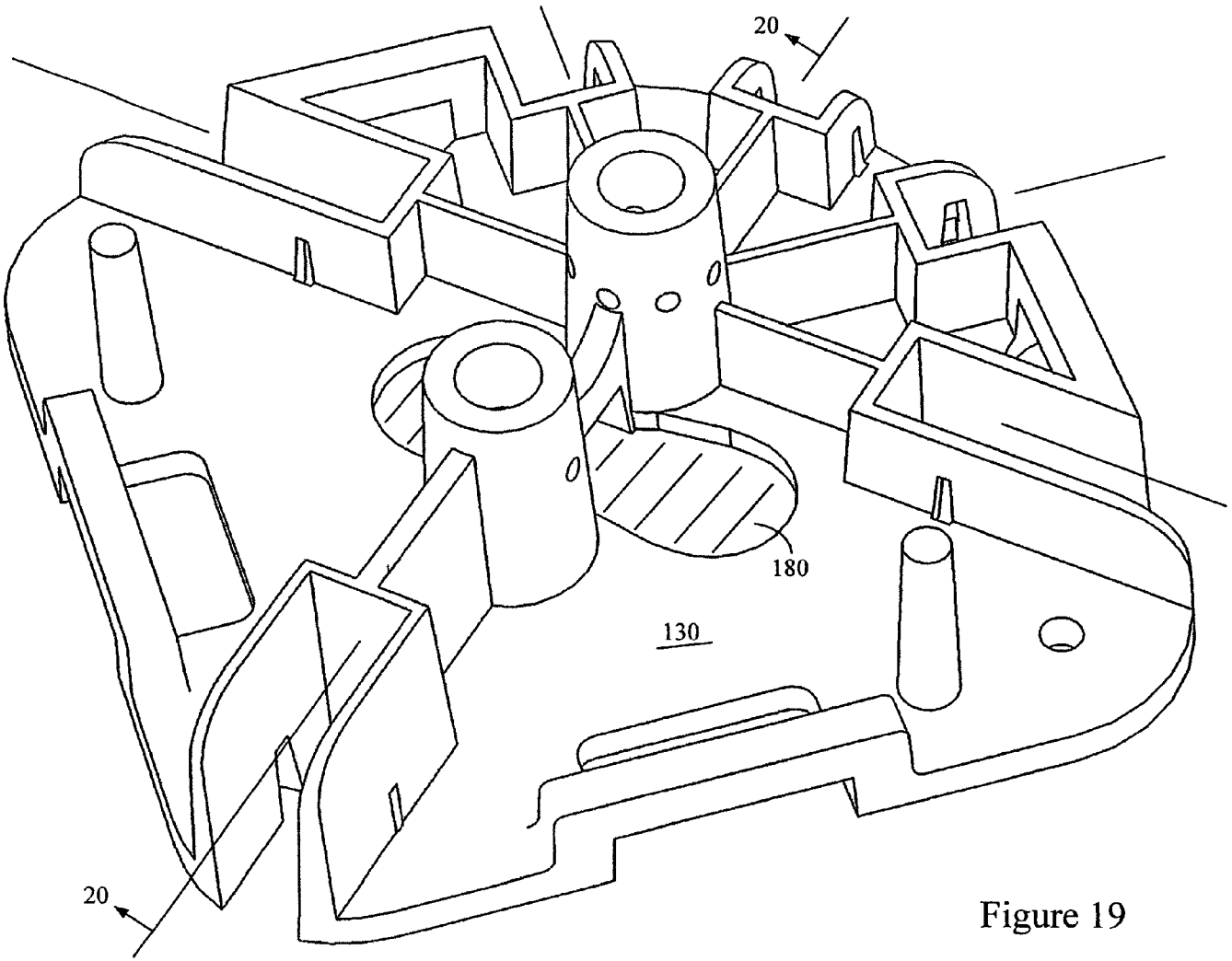
Figure 20:
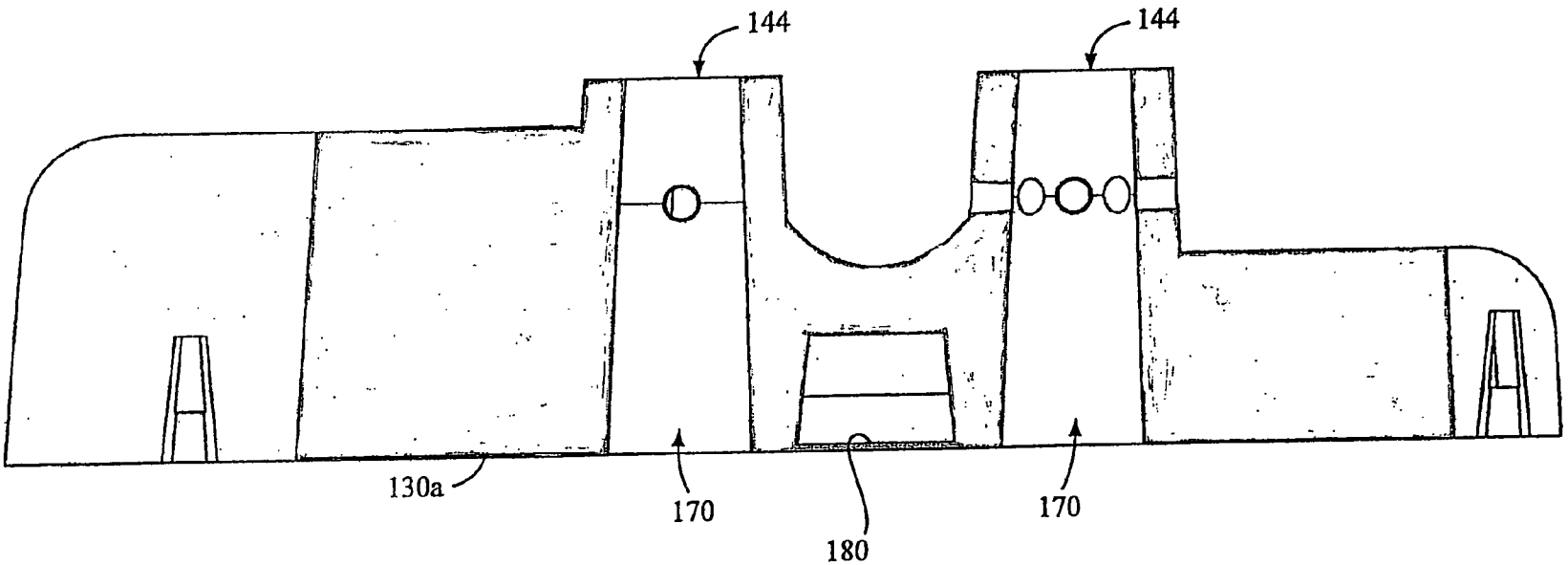
Figure 21:
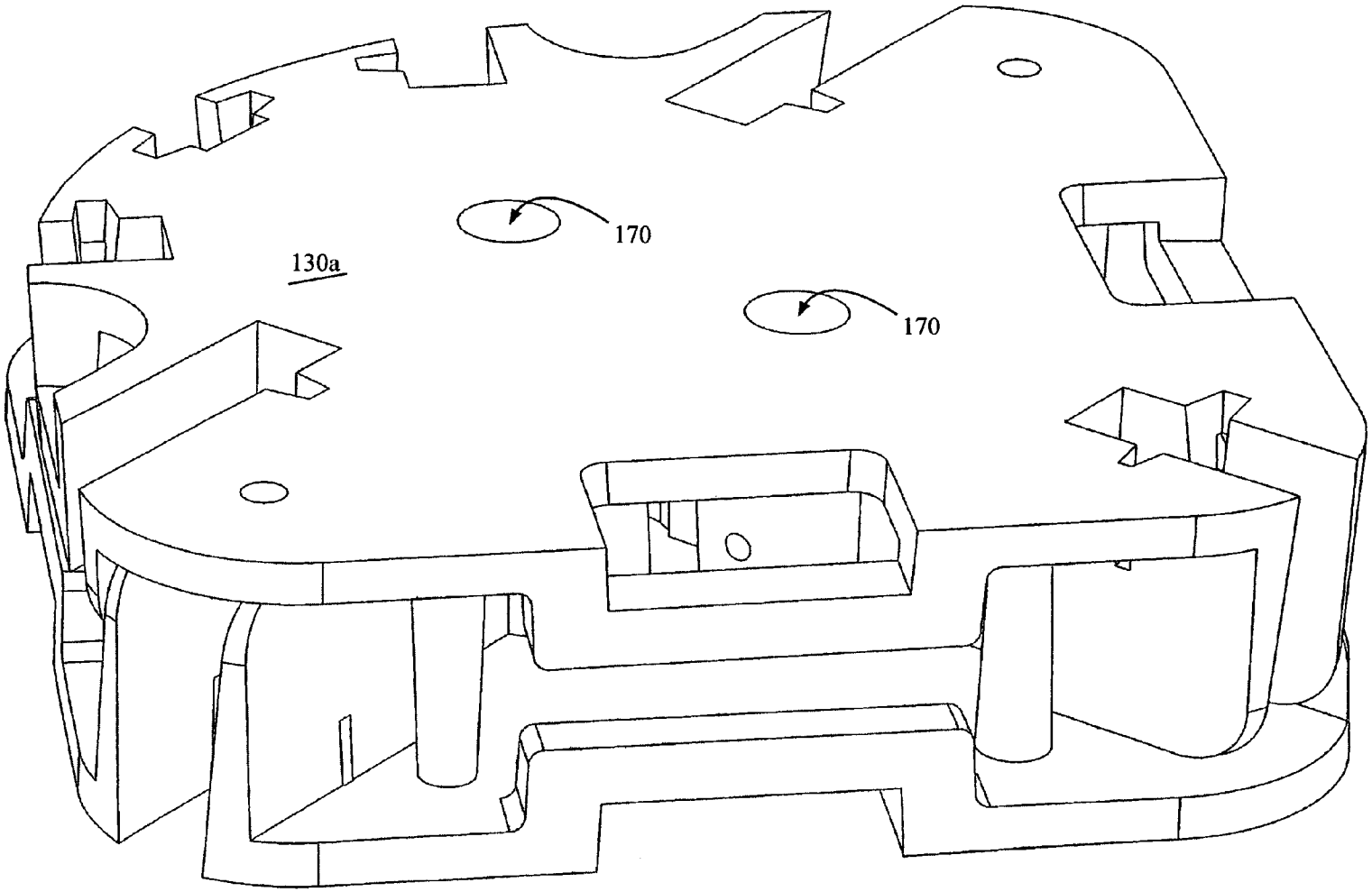

FIG. 8*a* is a schematic perspective view of an example embodiment of a base in accordance with the present invention analogous to the base shown in FIG. 5 but without one pair of transversely extending notch members;

FIG. 9 is a schematic perspective view of another example embodiment of a base in accordance with the present invention;

FIG. 10 is a schematic cross-sectional view along 10-10 of the base of FIG. 9;

FIG. 11 is a schematic perspective view of a portable safety railing using weighted bases as shown in FIG. 9 installed on a support surface;

FIG. 12 is a schematic top view of a portable safety railing using bases as shown in FIG. 9 installed on a support surface FIG. 13 is a schematic top view of a base as shown in FIG. 9 showing alternate positions for the toe rail (plank);

FIG. 14 is a schematic perspective side view of a barrier unit with one base as shown in FIG. 9 at one end and two bases as shown in FIG. 9 stacked face to face at the other end;

FIG. 15 is an enlarged schematic perspective side view of the stacked bases shown in FIG. 14;

FIG. 16 is a schematic illustration of stack of bases comprising two pairs of face to face stacked bases;

FIG. 17 is a schematic cross-sectional view of an alternate of a base as shown in FIG. 9 wherein the bottom side face presents a pair of socket engagement members opposite the support post engagement elements present by the top side face;

FIG. 18 is an enlarged schematic perspective side view of two stacked bases, i.e. each base being a base as shown in FIG. 17;

FIG. 19 is a schematic perspective view of another example embodiment of a base in accordance with the present invention wherein the female component opening does not interrupt the bottom side face, i.e. the female interlock opening while present by the top face side is blocked off by the bottom face side of the base;

FIG. 20 is a schematic cross-sectional view along 10-10 of the base of FIG. 19; and FIG. 21 is an enlarged schematic perspective side view of two stacked bases, i.e. each base being a base as shown in FIG. 19.

Referring to FIGS. 1 to 4, these figures illustrate a portable or temporary safety barrier system using support post bases as described in U.S. Pat. No. 3,776,521, i.e. appropriately weighted bases. The illustrated prior art safety barrier system (see FIG. 4) comprises a plurality of barrier sections or units (generally designated by the reference numerals 2, 4 and 6 respectively) which may be positioned on a working surface such as a roof or unfinished elevated floor of a building (not shown). Each barrier section comprises the same components, namely a horizontal barrier component 8 and two like support post bases 10.

Figure 3:
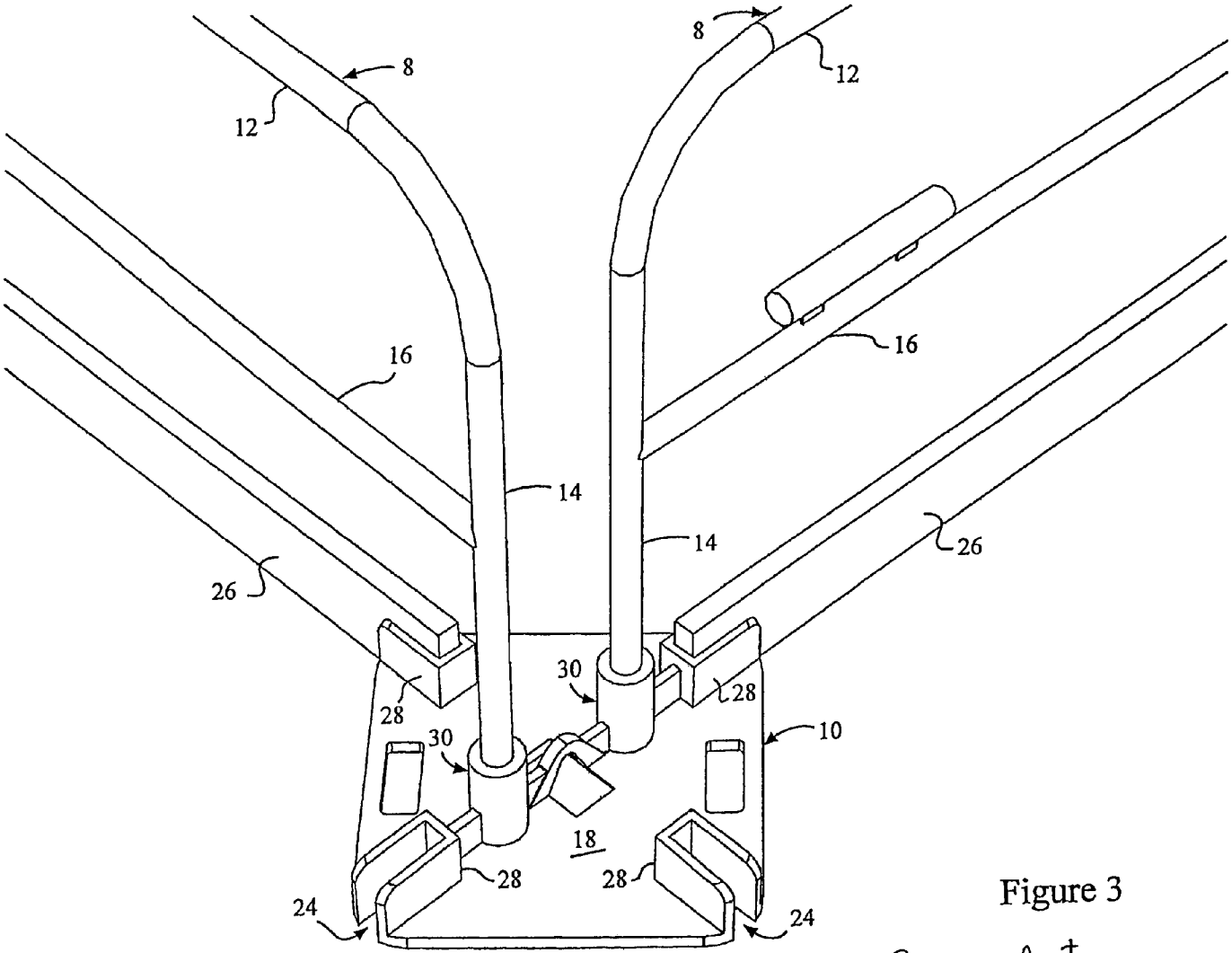
Figure 3 Prior Art
FIG. 3 is a schematic perspective view of a portable safety railing using bases as shown in FIG. 1 installed on a support surface (not shown)

Referring to FIG. 3, each horizontal barrier component 8 has a raised tubular horizontal bar or rail 12 supported at opposite ends by tubular posts or masts 14. The raised bar 12 and posts 14 may be fashioned, in any suitable known manner. Thus, the raised bar 12 and posts 14 may be obtained by appropriate bending of a single piece of (metal) tubular stock; the raised bar 12 and posts 14 may be fashioned from a plurality of straight tube elements and elbow elements (e.g. as by welding, and the like); etc. A barrier section or unit may if so desired, as shown in FIG. 3, have a lower secondary tubular element 16 fixed to the posts 14 in any suitable manner (e.g. welding, clamps, etc.). The posts 14 are maintained in an upright disposition by respective bases 10.

Figure 1:
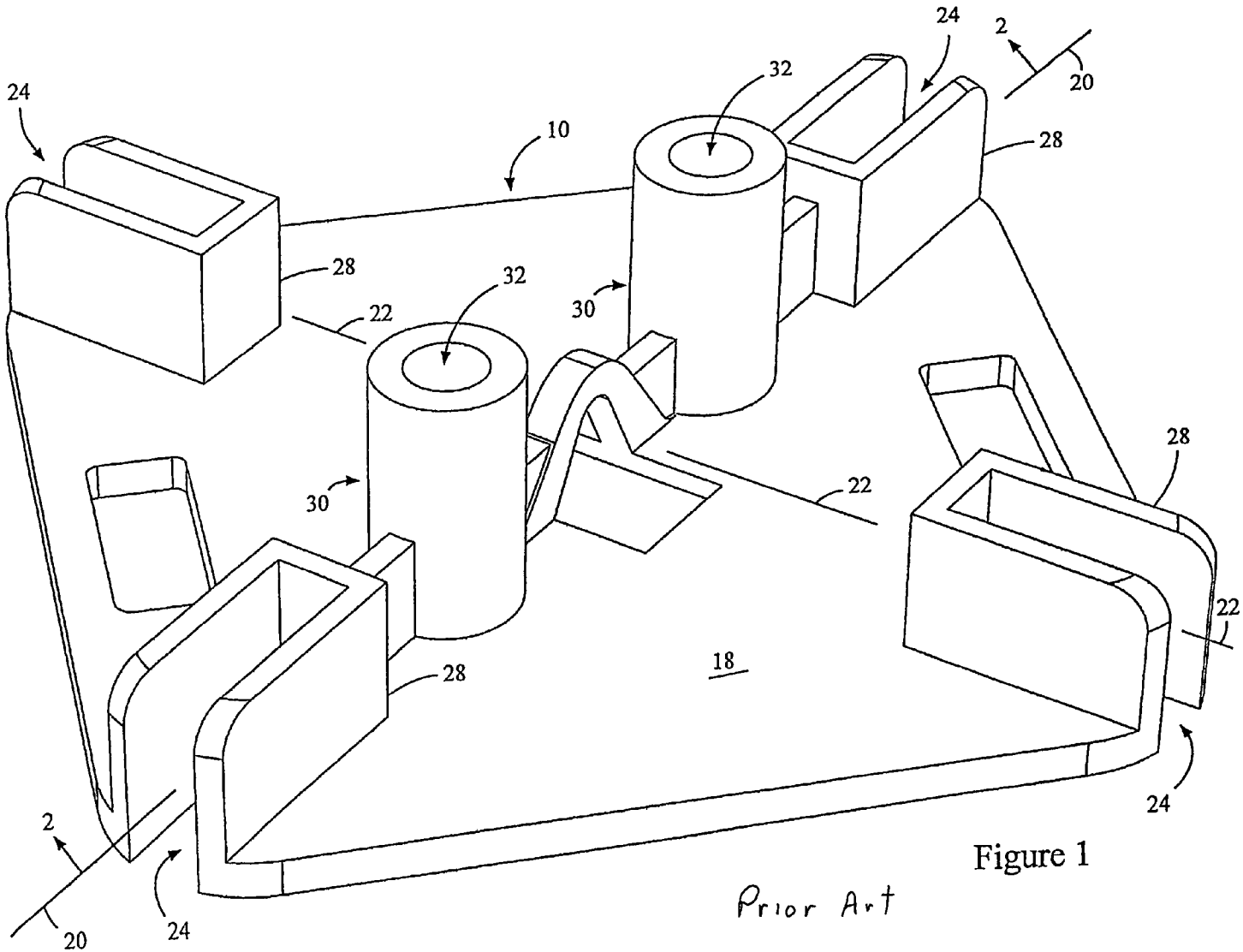
Figure 1 Prior Art

Referring in particular to FIG. 1, the base 10 has a body member of plate-like configuration. The base 10 has a top face side 18 and an opposed bottom face side 19 (see FIG. 2), the bottom face side 19 abutting or resting on the support surface (not shown). The base 10 has a square configuration such that it has a pair of transverse (e.g. perpendicular) horizontal longitudinal axii 20 and 22. The horizontal longitudinal axii 20 and 22 are coincident with a respective diagonal linking opposite corners of the base 10. The base 10 also has inwardly extending notches 24 disposed at each corner of the base 10 for releasably engaging the ends of a respective toe rail 26 (see FIG. 3) which is shown by way of example in the form of a plank (of wood). As shown, the periphery of the notches 20 include U-shaped flanges 28. The notches 24 pass from the top face side 18 to the bottom face side 19 of the base 10, i.e. the notches 24 pass entirely through the base 10 such that the toe rails 26 may rest on the working or support surface. Since the toe rails are able to rest on the support surface they are available to inhibit objects on the support surface from being kicked off of the support surface.

As may be appreciated, each pair of opposed notches 24 lies along a respective longitudinal (i.e. diagonal) axis 20 or 22.

Figure 2:
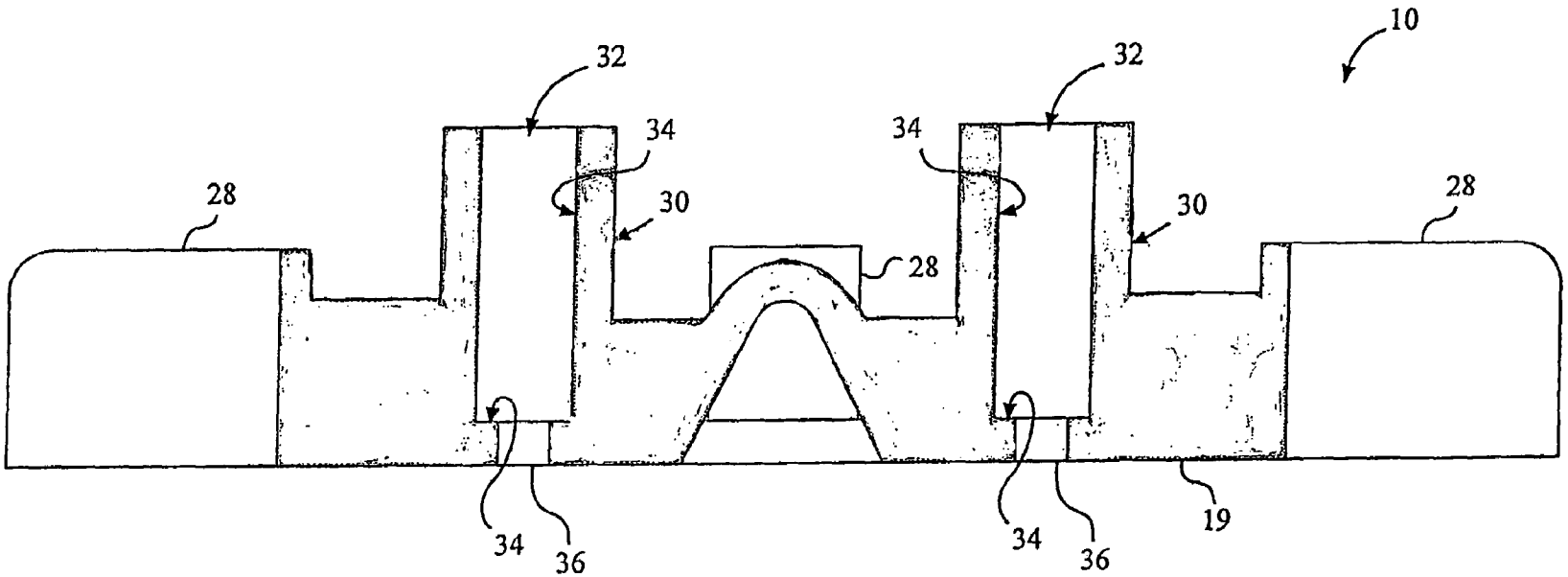
Figure 2 PRIOR ART
FIG. 2 is a schematic cross-sectional view along 2-2 of the prior art base of FIG. 1.

As shown in the FIGS. 1 to 4 the top face side 18 of the base 10 presents two support post engagement elements in the form of two socket members 30 for detachably maintaining respective posts 14 in an upstanding disposition. The socket members 30 each have an entrance mouth or opening 32 at the distal end thereof remote from the end thereof attached to the rest of the base 10. Referring to FIG. 2, the socket members 30 have a vertically extending inner side wall 34 defining a cavity communicating with the entrance mouth 32. The end of the cavity remote from the entrance mouth 32 has a post engagement member in the form of an inwardly extending ring ledge member 34 for engaging the end of the post received therein; the periphery of the ring ledge member 34 defines a relatively small opening 36. The entrance mouth 32 and the side wall 34 are sized and shaped such that the socket members 30 are capable of receiving the lower ends of the posts 14 for maintaining them in an upstanding disposition. The socket members 30 are spaced apart along the horizontal longitudinal axis 20. Thus the prior art base 10 taught by U.S. Pat. No. 3,776,521 has a transverse horizontal longitudinal axis 22 along which there is disposed a pair (i.e. two) of notches 24 but no socket member 30; and a transverse horizontal longitudinal axis 20 along which there is disposed another pair of notches 24 as well as the two socket members 30, the two socket members 30 being disposed between the respective pair of notches.

Figure 4:
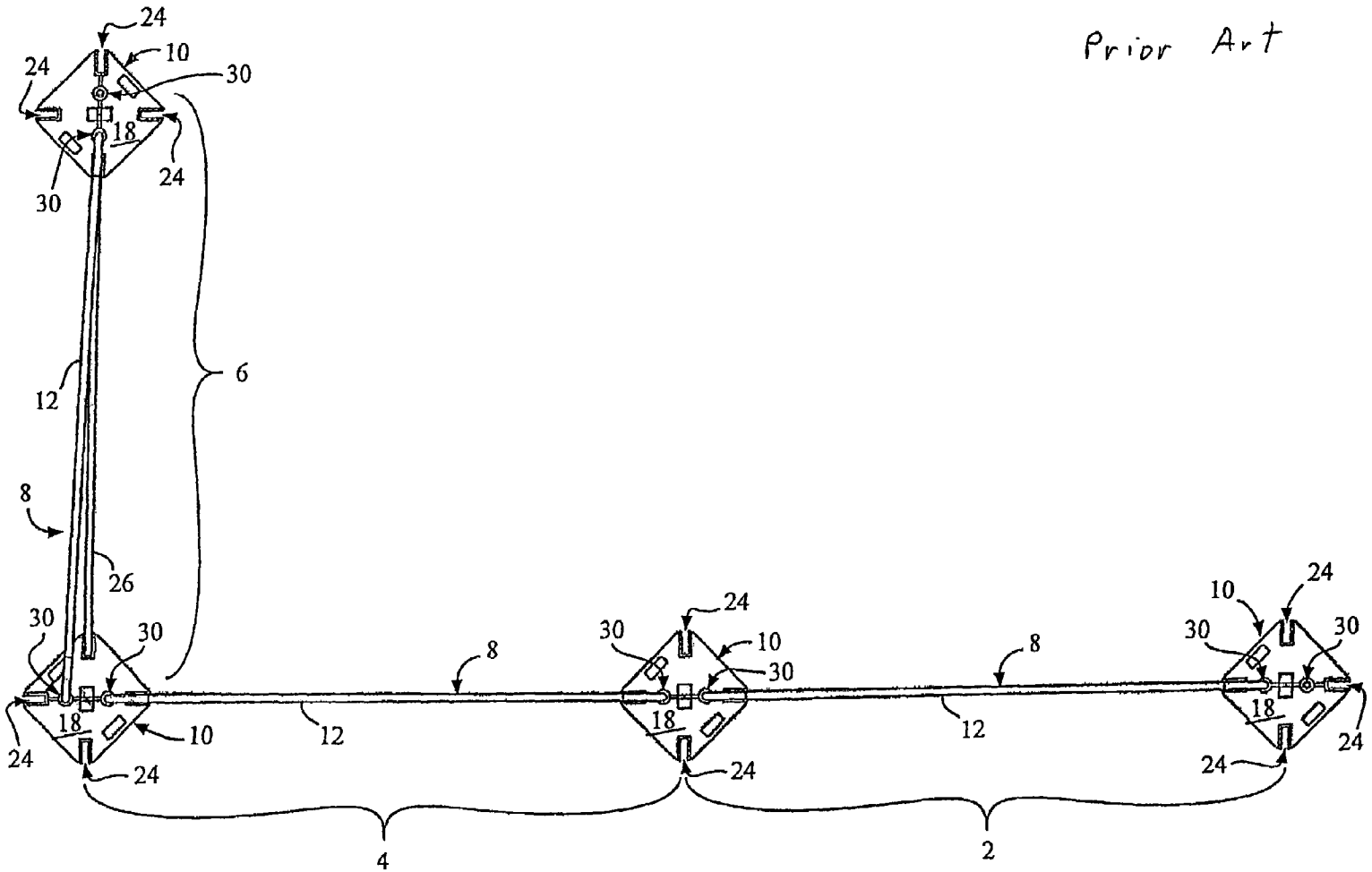
Figure 4 Prior Art
FIG. 4 is a schematic tope view of a portable safety railing using bases as shown in FIG. 1 installed on a support surface.

As may be appreciated from FIG. 4, when the barrier sections 2 and 4 are viewed from above, the underlying toe rails 26 thereof, are aligned with the overhead tubular horizontal bar or rail 12 (i.e. are parallel therewith or lie in the same vertically flat plane). However, the situation is different for barrier section 6 which defines a portion of a (square) corner of the safety barrier system shown. When barrier section 6, is viewed from above, the overhead tubular horizontal bar or rail 12 is misaligned in relation to the underlying toe rail 26, i.e. when viewed from above the overhead tubular horizontal bar or rail 12 is non-parallel to the underlying toe rail 26 so that horizontally there is a gap between the rail 12 and rail 26.

Turning to FIGS. 5 to 8, these figures illustrate a temporary safety barrier system in accordance with the present invention. Thus the illustrated safety barrier system also comprises a plurality of barrier sections or units (generally designated by the reference numerals 42, 44 and 46 respectively) which may be positioned on a support or working surface such as a roof or unfinished elevated floor of a building (not shown).

Figure 6:
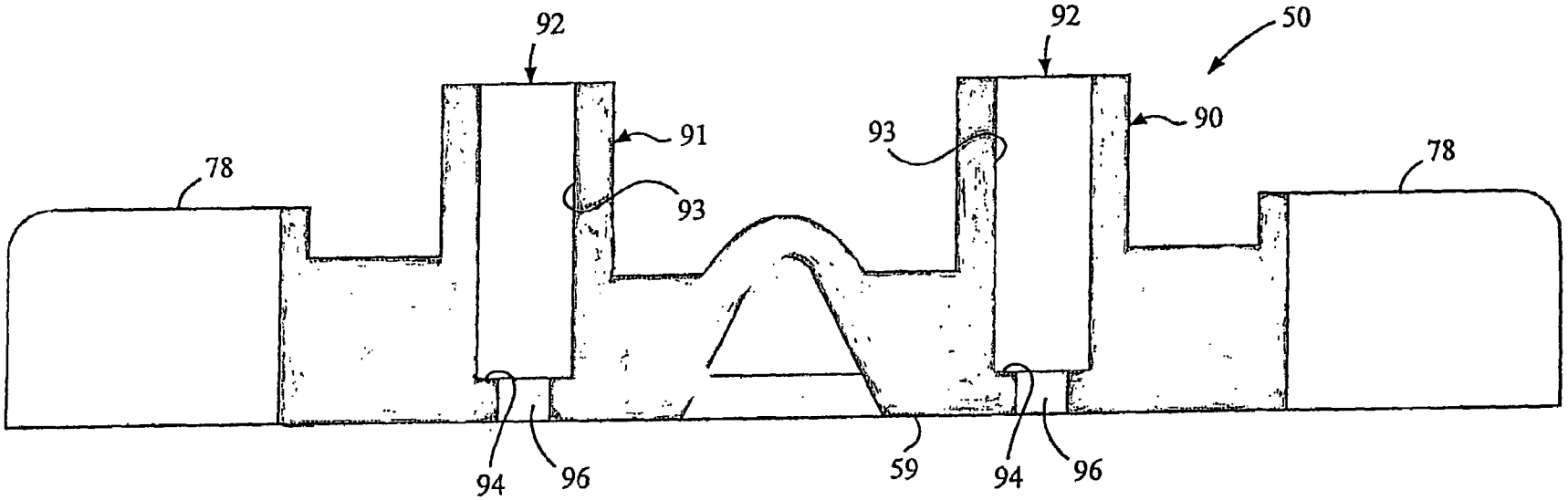
FIG. 6 is a schematic cross-sectional view along 6-6 of base of FIG. 5.
Figure 7:
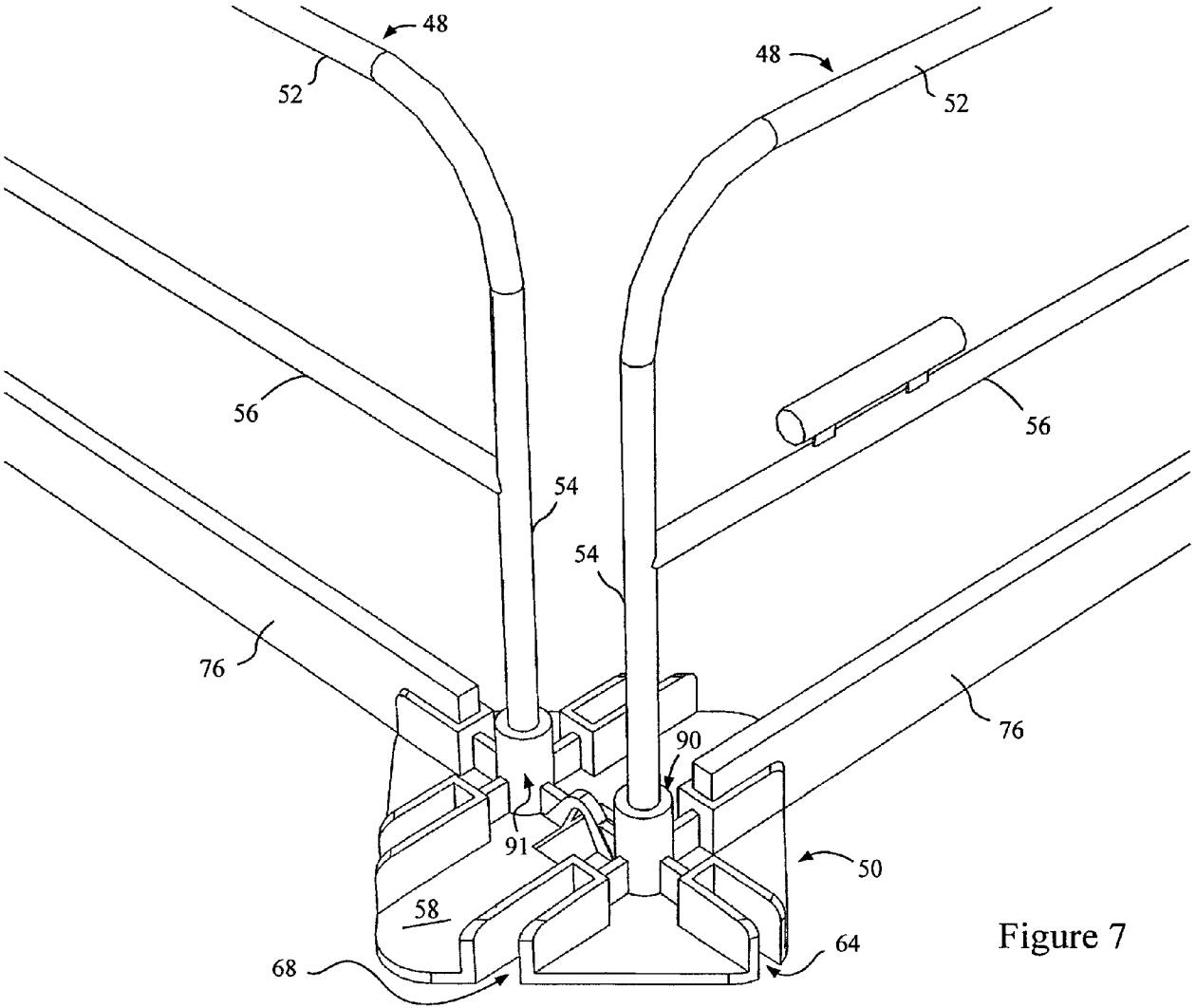
FIG. 7 is a schematic perspective view of a portable safety railing using bases as shown in FIG. 5 installed on a support surface.

Each barrier section 42, 44 and 46 comprises the same components namely a horizontal barrier component 48 and two like post support bases 50. Referring to FIG. 7, the horizontal barrier component 48 comprises a raised tubular horizontal bar or rail 52 supported at opposite ends by tubular posts or masts 54; the horizontal barrier component 48 may if so desired, as shown in FIG. 6, have a lower secondary tubular element 56 fixed to the posts 54. The tubular horizontal bar or rail 52, posts 54 and secondary tubular element 56 may be constructed in any known manner such as for example mentioned above with respect to the prior art barrier system. The posts 54 are maintained in an upright disposition by respective bases 50.

Referring to FIG. 5, the base 50 has a body member of plate-like configuration. The base 50 also has a top face side 58 and an opposed bottom face side 59 (see FIG. 6), the bottom face side 59 abutting or resting on the support surface (not shown). The base 50 has a square-like configuration. However, although the base 50 has three horizontal longitudinal axii 60, 61 and 62, only horizontal longitudinal axis 60 is coincident with a diagonal linking opposite corners of the base 50. The other horizontal longitudinal axii 61 and 62 are disposed on opposite sides of and parallel to the other diagonal. On the other hand, the horizontal longitudinal axii 61 and 62 are disposed perpendicular (i.e. transverse) to the diagonal longitudinal axis 60.

Turning to FIGS. 5 and 7 the base 50 has three pairs of opposed inwardly extending notches (designated generally by respective reference numbers 64, 66 and 68) for releasably engaging the ends of a respective toe rail 76 (see FIG. 7) which is shown by way of example in the form of a plank (of wood).

As shown, the periphery of the notches 64, 66 and 68 include respective U-shaped flanges 78, 80 and 82. The notches 64, 66 and 68 pass from the top face side 58 to the bottom face side 59 of the base 50, i.e. for the example base 50, the notches 64, 66 and 68 pass entirely through the base 50 such that the toe rails 76 may rest on the working or support surface. Since the toe rails 76 are able to rest on the support surface they are available to inhibit objects on the support surface from being kicked off of the support surface. It is to be understood, however, that if necessary or desired the notches may be so configured that that they do not entirely pass through the base from the top side face. Furthermore, athough not shown, a notch pair may if desired be replaced by a single notch member which passes completely across the body of the base, e.g. a notch which passes through the socket members along axis 120.

As may be appreciated, the pair of opposed notches 64 lies along respective horizontal longitudinal (i.e. diagonal) axis 60; the pair of opposed notches 66 lies along respective horizontal longitudinal axis 61; and the pair of opposed notches 68 lies along respective horizontal longitudinal axis 62.

Although the base 50 is shown with two pairs of notches (66 and 68) disposed along respective horizontal longitudinal axii 61 and 62, if desired or necessary one pair of notches (66 or 68) may be dispensed with (i.e. not be present); see FIG. 8*a* wherein the same reference numerals are used to designate common base elements and wherein notches 66 are dispensed with. Furthermore, a base as desired or necessary may, for example, include only one notch disposed along horizontal longitudinal axis 61 and/or 62.

As shown in the FIGS. 5 to 8 the top face side 58 of the base 50 presents two support post engagement elements in the form of two socket members 90 and 91 for detachably maintaining respective posts 54 in an upstanding disposition. The socket members 90 and 91 each have an entrance mouth or opening 92 at the distal end thereof remote from the end thereof attached to the rest of the base 50. Referring to FIG. 6, the socket members 90 and 91 have a vertically extending inner side wall 93 defining a cavity communicating with the entrance mouth 92. The end of the cavity remote from the entrance mouth 92 has a post engagement member in the form of an inwardly extending ring ledge member 94 for engaging the end of the post received therein; the periphery of the ring ledge member 94 defines a relatively small opening 96. The entrance mouth 92 and the side wall 94 are sized and shaped such that the socket members 90 and 91 are capable of receiving the lower ends of the posts 54 for maintaining them in an upstanding disposition. The socket members 90 and 91 are spaced apart along the horizontal longitudinal axis 60.

The socket members could of course take any other configuration keeping in mind their function, namely to maintain the posts 54 in an upstanding disposition. The socket members 90 and 91 are each spaced apart along the (diagonal) horizontal longitudinal axis 60. The socket member 90 alone is also disposed along the transverse horizontal longitudinal axis 62. The socket member 91 alone is also disposed along the transverse longitudinal axis 61.

The base in FIGS. 5 to 8 is shown with the two socket members 90 and 91 disposed along the diagonal horizontal longitudinal axis 60 between notches 64. Alternatively, if for example, the base only includes notches 64 and 68 as shown in FIG. 8*a*, then a base may be made wherein only the socket member 90 may be disposed along the diagonal horizontal longitudinal axis 60 and a second socket member may be disposed along the horizontal longitudinal axis 62 between the notches 68; in this case socket member 91 being of course removed. As a further alternative the base 50 may if desired or necessary be provided with one or more additional socket members. For example, although not shown, the base 50 may have a third socket member disposed along one of the horizontal longitudinal axii 61 and/or 62 between respective notches. As a further alternative the base 50 may in addition to the third socket have a fourth socket member whereby the third socket member may disposed along one of the longitudinal axii 61 and 62 whereas the fourth socket member may be disposed along the other of the longitudinal axii 61 and 62.

In any event, turning back to FIGS. 5 to 8, contrary to the prior art weighted base taught by U.S. Pat. No. 3,776,521, the example base of the present invention as shown in FIGS. 5 to 8 has at least one longitudinal axis along which there is disposed two notches as well as one socket member; and a transverse longitudinal axis along which there is disposed two notches and between which is disposed two socket members. This configuration has the salutary effect of facilitating the fabrication of cleanly defined corner elements of a temporary safety barrier system.

As may be appreciated from FIG. 8, when the barrier sections 42 and 44 are viewed from above, the underlying toe rails 76 thereof, are aligned with the overhead tubular horizontal bar or rail 52 (i.e. are parallel therewith or lie in the same vertically flat plane). The situation is the same for barrier section 46 which defines a portion of a (square) corner of the safety barrier system shown. When barrier section 46, is viewed from above, the overhead tubular horizontal bar or rail 22 is aligned in relation to the underlying toe rail 76, i.e. when viewed from above the overhead tubular horizontal bar or rail 52 is parallel to the underlying toe rail 76 so that horizontally there is no gap between the rail 52 and rail 76.

Turning to FIGS. 9 to 12 these figures illustrate a further example of a temporary safety barrier system in accordance with the present invention. The illustrated safety barrier system also comprises a plurality of barrier sections or units (generally designated by the reference numerals 102, 104 and 106 respectively) which may be positioned on a working surface such as a roof or unfinished elevated floor of a building (not shown).

Each barrier section 102, 104 and 106 comprises the same components namely a horizontal barrier component 108 and two like post support bases 110. Referring to FIG. 11, the horizontal barrier component 108 comprises a raised tubular horizontal bar or rail 112 supported at opposite ends by tubular posts or masts 114. The tubular horizontal bar or rail 112, and posts 114 may be constructed in any known manner such as for example mentioned above with respect to the prior art barrier system. Each barrier section 102, 104 and 106 may if so desired, as shown in FIG. 11 have, for example, a lower secondary element 116 fixed to the lower part of the outer posts 114 in any suitable manner (e.g. welding, clamps, etc.). The lower secondary element 116 is shown with an optional downwardly extending flange element 118 provided with openings (one of which is designated with the reference numeral 120) for receiving fastener elements such as screws, nails, bolts or the like for fixing a toe rail 122 (see below) to the lower secondary element 116. The horizontal barrier component 108 in the example embodiment shown is also provided with an optional wire grid fence component 124 in place of the secondary tubular element 56 shown in FIG. 7; the wire grid fence component 124 at its peripheral sides is attached in any suitable known manner (e.g. by welding, mechanically) to the raised tubular horizontal bar or rail 112, the outer posts 114 and the lower secondary element 116. The posts 114 are maintained in an upright disposition by respective bases 110.

Referring to FIG. 9, the base 110 has a body member of plate-like configuration. The base 110 also has a top face side 130 and an opposed bottom face side 130*a* (see FIG. 10), the bottom face side 130*a* abutting or resting on the support surface (not shown). The base 110 has a cone like configuration (i.e. resembling an ice cream cone with a rounded scope of ice-cream). The base 110 has four horizontal longitudinal axii 120, 121, 122 and 123; the axii are all disposed transverse to each other. The horizontal longitudinal axii 120 and 121 are disposed perpendicular to each other while the remaining axii 122 and 123 are each disposed transverse to both of the horizontal longitudinal axii 120 and 121.

Turning to FIG. 9 the base 110 has two pairs of opposed inwardly extending notches (designated generally by respective reference numbers 131 and 132) as well as two solitary inwardly extending notches 134 and 136 for releasably engaging the ends of a respective toe rail 122 (see FIG. 11) which is shown by way of example in the form of a plank (of wood).

As shown, the periphery of the notches 131, 132, 133 and 134 include respective U-shaped flanges. The notches 131, 132, 133 and 134 pass from the top face side 130 to the bottom face side 130*a* of the base 110, i.e. for the example base 110, the notches 131, 132, 133 and 134 pass entirely through the base 110 such that the toe rails 122 may rest on the working or support surface. Since the toe rails 122 are able to rest on the support surface they are available to inhibit objects on the support surface from being kicked off of the support surface. It is to be understood, however, that if necessary or desired the notches may be so configured that that they do not entirely pass through the base from the top side face.

As may be appreciated, the pair of opposed notches 131 lies along respective horizontal longitudinal axis 120; the pair of opposed notches 132 lies along respective horizontal longitudinal axis 121; the lone notch 134 lies along the horizontal longitudinal axis 122 and the lone notch 136 lies along respective horizontal longitudinal axis 123.

As shown in the FIGS. 9 to 13 the top face side 130 of the base 110 presents two support post engagement elements in the form of two socket members 140 and 142 for detachably maintaining respective posts 114 in an upstanding disposition. The socket members 140 and 142 each have an entrance mouth or opening 144 at the distal end thereof remote from the end thereof attached to the rest of the base 110. Referring to FIG. 10, the socket members 140 and 142 have a vertically extending inner side wall 146 defining a cavity communicating with the entrance mouth 144. The end of the cavity remote from the entrance mouth 144 has a post engagement member in the form of an inwardly extending ring ledge member 148 for engaging the end of the post received therein; the periphery of the ring ledge member 148 defines a relatively small opening 150. The entrance mouth 144 and the side wall 146 are sized and shaped such that the socket members 140 and 142 are capable of receiving the lower ends of the posts 114 for maintaining them in an upstanding disposition. The socket members 140 and 142 are spaced apart along the horizontal longitudinal axis 120.

The socket members could of course take any other configuration keeping in mind their function, namely to maintain the posts 114 in an upstanding disposition. The socket members 140 and 142 are each spaced apart along the horizontal longitudinal axis 120 between notches 131. The socket member 140 alone is also disposed along the transverse horizontal longitudinal axii 121, 122 and 123, i.e. at the intersection of the horizontal longitudinal axii 121, 122 and 123 with the horizontal longitudinal axis 120.

Thus referring in particular to FIGS. 9 and 13, the socket members 140 and 142 are spaced apart along the longitudinal axis 120 along with inwardly extending notches 131. The socket member 140 is also disposed along the transverse horizontal longitudinal axis 121 along with inwardly extending notches 132. However, the socket member 140 is also disposed along the transverse horizontal longitudinal axii 122 and 123 along with respective inwardly extending notches 134 and 136. These additional notches 134 and 136 provide for the possibility of angled corners (e.g obtuse angled corners) with angles greater than 90 degrees such as for example 135 degrees, 215 degrees, etc.

As may be appreciated from FIG. 12, when the barrier sections 102 and 104 are viewed from above, the underlying toe rails 122 thereof, are aligned with the overhead tubular horizontal bar or rail 112 (i.e. are parallel therewith or lie in the same vertically flat plane). The situation is the same for barrier section 106 which defines a portion of a (square) corner of the safety barrier system shown. When barrier section 106, is viewed from above, the overhead tubular horizontal bar or rail 112 is aligned in relation to the underlying toe rail 122, i.e. when viewed from above the overhead tubular horizontal bar or rail 112 is parallel to the underlying toe rail 122 so that horizontally there is no gap between the rail 112 and rail 122.

Thus, again contrary to the prior art base taught by U.S. Pat. No. 3,776,521, the example support post base of the present invention as shown in FIGS. 9 to 13 has at least one horizontal longitudinal axis along which there is disposed two notches and between which is disposed two socket members; and one or more transverse horizontal longitudinal axii along which there is disposed one or two notches and only one socket member. This configuration as mentioned has the salutary effect of facilitating the fabrication of cleanly defined corner elements of a temporary barrier installation.

As mentioned above, the present invention provides a base which may be stacked in face to face arrangement so as, necessary or desired, to facilitate transportation and/or storage and/or to provide a base member of increased weight (i.e. of double the weight).

Still referring to FIGS. 9 to 15 and in particular FIGS. 9, 14 and 15, as mentioned above the present invention also provides a base whish may be configured so as to be stacked in face to face arrangement so as, for example, to provide a base member of increased weight (i.e. of double the weight). The base as shown in to figure(s) 9 (to 15) is such a stackable base; see FIG. 15 wherein a stack of two bases, each of configuration as shown in FIG. 9, is designated by the general reference numeral 160 and wherein the individual underlying base is designated by the reference numeral 110*a* and the overlying base is designated by the reference numeral 110*b*.

As may be seen from FIG. 15, which shows the bottom face 130*a* of the overlying base 110*b*, a base of configuration as shown in FIG. 9, has a more or less flat configuration for engagement with an underlying support surface. Referring back to FIG. 9, the base has a female component (for interlock with a male element of like base) in the form of an elongated opening 162 disposed between the sockets members 140 and 142 so as to lie along a further horizontal longitudinal axis 164 which is perpendicular to horizontal longitudinal axis 120. The elongated opening 162 extends right through the body of the base from the front face side 130 to the bottom face side 130*a* thereof (see FIG. 15). As may be seen, (from FIGS. 9 and 15) the elongated opening 162 is configured so as to present a female component aspect in relation to the pair of socket members 140 and 142 of a like configured base. In this respect the socket members 140 and 142 have the aspect of male members.

The front face side 130 of the base (including the elongated opening 162 and the socket members 140 and 142) is configured such that, referring to FIG. 15, a like configured base 110*b* may be oriented top face side to top face side over the base 110*a* with the respective elongated openings 162 disposed such that their respective longitudinal axis 164 are at right angles to each other. As may also be seen from FIG. 15, in this position, the lower and upper bases 110*a* and 110*b* are disposed such that their respective axii 120 are also at right angles; the axis 120 for the underlying base 110*a* being shown in dotted outline and the axis 120 for the overlying base 110*b* being shown in solid outline. Once in this proper face to face position, the upper base 110*b* may be lowered onto the underlying base 110*a* such that its socket members 140 and 142 are able to be received in or engage the elongated opening 162 of the base 110*a*. Once the upper base 110*b* is fully placed on top of the underlying base 110*a* the socket members 140 and 142 of the underlying base 110*a* are engaged in the corresponding elongated opening 162 of the overlying base (see FIG. 15); i.e. the distal ends of the socket members are disposed in the elongated opening 162 of the overlying base 110*b*. As may be appreciated the two stacked bases 110*a* and 110*b* as shown in FIG. 15 are interlocked such that relative horizontal lateral rotational movement (e.g. in the direction of the double headed arrow 166) as well as linear vertical movement (e.g. in the direction of the double headed arrows 168 and 170) of the two stacked weighted base is inhibited. Additionally the entrance mouth 144 of the socket members of the underlying weighted base are exposed such that the post of a barrier component may then be engaged with a socket member as shown in FIG. 14; as shown the entrance mouth 144 is disposed within the elongated opening 162 more or less flush with the outer surface of bottom face side 130*a* but may if desired be somewhat set back into the elongated opening 162. Furthermore as also may be seen from FIGS. 14 and 15, the base configuration is such that the notches of the underlying base 110*a* are exposed for engagement with a suitable toe rail (see FIG. 14).

Referring to FIG. 16 this shows two pairs of stacked bases 130 stacked one on the other for possible storage or transport, i.e. bottom face side to bottom face side. As may be appreciated the four member stack may be used as a weighted support (i.e. a 4× weighted base support) for holding in upstanding disposition a post configured to pass through the cavities of the socket members of the two underlying bases of each pair 160 of stacked bases.

As mentioned above, for the example embodiment of a base in accordance with the present invention as shown in FIG. 9 (as well as FIGS. 10 to 16), the elongated opening 162 is are configured to allow the mouth entrance 144 of the socket members 140 and 142 to be exposed for engagement with a post (see FIG. 15).

Referring to FIGS. 17 and 18, an alternate example base structure is shown wherein the bottom side face presents a pair of socket engagement members opposite the support post engagement elements presented by the top side face; like reference numerals are used to refer to like elements shown in FIGS. 9 to 16. As may be seen the base shown in FIGS. 17 and 18 differs from the base shown in FIGS. 9 to 16 in that alternatively, if desired or necessary, the end of a socket member remote from the socket entrance or mouth opening 144 may not be provided with the above mentioned peripheral inwardly extending ring ledge member 148 but may instead be configured and sized relative to the end portion of the post to have an opening 170 able to allow the end portion of a respective post to pass there through from the bottom face side 130*a* of a base when in stacked configuration with another underlying like base. As shown the base of FIG. 17 has a socket cavity that extends from the top face side to the bottom face side thereof. With this base configuration a pair of such stacked bases may provide for four post engagement openings rather than the two as shown in FIG. 15. Although in FIG. 17 the bottom side face socket engagement members are shown as being opposite the top side face support post engagement elements, the bottom side face socket engagement members may of course be disposed elsewhere about the bottom face side.

In accordance with a further embodiment shown in FIGS. 19, 20 and 21, and based on the embodiment shown in FIGS. 17 and 18, the elongated openings 162 may be blocked off at the bottom face side, leaving only the openings 170 mentioned above, free for engagement with a respective post. Referring to FIGS. 19, 20 and 21, this alternate example base structure is shown wherein the bottom side face presents a pair of socket engagement members opposite the support post engagement elements presented by the top side face; like reference numerals are used to refer to like elements shown in FIGS. 9 to 18. As may be seen the base shown in FIGS. 19, 20 and 21 differs from the base shown in FIGS. 17 and 18 in that alternatively, if desired or necessary, the elongated opening 162 is blocked off from the bottom side face 130*a* by an opening floor 180 such that the floor 180 covers the openings 144 when in stacked configuration with another underlying like base. As may be appreciated if such two like base are placed top face side to top face side as discussed above, the openings 144 of the socket members are blocked off by the body of the base so that socket members of the underlying base are not available for engagement with the lower end of the posts. Thus with this base configuration a pair of such stacked bases may provide for two post engagement openings rather than the four as shown in FIG. 18. Although in FIG. 20, the bottom side face socket engagement members are shown as being opposite the top side face support post engagement elements, the bottom side face socket engagement members may of course be disposed elsewhere about the bottom face side.

Still referring to FIGS. 9 to 15, the example base as illustrated is also provided with upstanding post engagement pins 190. The pins 190 may be used to engage the end of a tubular post of a horizontal barrier component (as shown in dotted outline in FIG. 12) which may for example as shown be oriented transversely to the barrier units 102 and 104. In this manner additional weight may be brought to bear to inhibit tipping of the barrier units 102 and 104 forming part of the straight portion of the barrier system shown in FIG. 12. The distal end of the transverse horizontal barrier component may also be engaged with a base as described herein (also as shown in dotted outline in FIG. 12).

Alternatively, or in addition the top face side of a base may be configured such that the pins 190 may engage in female counterparts appropriately presented on the top face side of a like configured base, i.e. for interlocking stacked pairs of bases. For example, the pins 190 and appropriate female counterpart elements could be used in place of the male socket and female opening shown in FIGS. 9 to 15.

A base in accordance with the present invention may, for example, as desired or necessary, as shown in FIG. 9 be provided with upstanding (U-shaped) hand hold elements (designated generally by the reference numeral 196) to facilitate manual pick and transport of the base.

A base may, for example, as desired or necessary, also be provided with post locking means for releaseably locking a post to a base. Post locking means may, for example, take the form of lateral openings 98 (see FIG. 9) in the side walls of socket members 140 and 142 through which a locking pin may be inserted for passage into or through a respective opening (not shown) in the end of a post aligned with the corresponding opening 198.

The invention claimed is:

1. A support post base, said base having a top face side, an opposed bottom face side for contacting a support surface, two spaced apart first toe rail holder elements, and two spaced apart second toe rail holder elements, said top face side presenting a first support post engagement element spaced apart from a second support post engagement element, each support post engagement element being configured for detachably engaging a support post for upstanding disposition thereof, each toe rail holder element being respectively configured for detachably engaging a respective toe rail member for horizontal disposition thereof, the two spaced apart first toe rail holder elements and the first and second support post engagement elements each being disposed along a first horizontal alignment axis such that the first and second support post engagement elements are disposed between said two spaced apart first toe rail holder elements, the two spaced apart second toe rail holder elements and the first support post engagement element being disposed along a second horizontal alignment axis such that the first support post engagement element is disposed between said two spaced apart second toe rail holder slot elements, said second horizontal alignment axis being disposed transverse to the first horizontal alignment axis and intersecting the first horizontal alignment axis at an intersection, and the first support post engagement element being disposed at the intersection of the first horizontal alignment axis and the second horizontal alignment axis.

2. A base as defined in claim 1 wherein said first post engagement element and said second post engagement element each comprises a respective socket element defining a socket for engaging a respective support post for upstanding disposition of said support post.

3. A base as defined in claim 2 wherein the socket elements of the base each have distal ends, wherein the base further comprises a female component disposed along a third horizontal alignment axis, said third horizontal alignment axis being transverse to said first horizontal alignment axis and being between said first and second support post engagement elements, said female component comprising an opening extending from said top face side to said bottom face side, and wherein said first support post engagement element, said second support post engagement element, said female component, said top face side and said bottom face side, are configured such that, when two of said bases are stacked top face to top face whereby one base is an overlying base and the other base is a lower base the socket elements of each base are able to register with the female component of the other base so as to be able to interlock both bases such that relative horizontal displacement thereof is inhibited, the distal ends of the socket elements of each of the bases are disposed in the opening of the female component of the other base and, the socket elements of the lower base are able to detachably engage a respective support post for upstanding disposition thereof.

4. A base as defined in claim 1 wherein second horizontal alignment axis is perpendicular to said first horizontal alignment axis.

5. A base as defined in claim 2 wherein second horizontal alignment axis is perpendicular to said first horizontal alignment axis.

6. A base as defined in claim 3 wherein second horizontal alignment axis is perpendicular to said first horizontal alignment axis.

7. A kit for a portable safety barrier system comprising at least two bases as defined in claim 1 or 2 and at least one portable safety barrier unit comprising a horizontal barrier component attached to two spaced apart support posts.

* * * * *